US006695593B1

(12) United States Patent
Steck et al.

(10) Patent No.: US 6,695,593 B1
(45) Date of Patent: Feb. 24, 2004

(54) FIBER OPTICS SYSTEMS FOR HIGH PURITY PUMP DIAGNOSTICS

(75) Inventors: Ricky B. Steck, West Jordan, UT (US); Michael Dunn, Sandy, UT (US); Troy Orr, Draper, UT (US); Matthew Stillings, Sandy, UT (US); David Kingsbury, Sandy, UT (US)

(73) Assignee: Trebor International, Inc., West Jordan, UT (US)

( * ) Notice: Subject to any disclaimer, the term of this patent is extended or adjusted under 35 U.S.C. 154(b) by 84 days.

(21) Appl. No.: 10/170,082

(22) Filed: Jun. 11, 2002

Related U.S. Application Data

(63) Continuation-in-part of application No. 09/946,752, filed on Sep. 4, 2001, now Pat. No. 6,402,486, which is a continuation of application No. 09/642,426, filed on Aug. 21, 2000, now abandoned, which is a continuation of application No. 09/166,490, filed on Oct. 5, 1998, now Pat. No. 6,106,246.

(51) Int. Cl.[7] ..... F04B 43/06; F04B 49/00

(52) U.S. Cl. ..... 417/395; 417/63; 418/2

(58) Field of Search ..... 417/46, 63, 375, 417/393, 394, 395, 474, 360, 405; 92/98 R, 99, 100, 102, 103, 103.5; 418/2, 45; 73/168; 385/12; 356/477, 478, 901

(56) References Cited

U.S. PATENT DOCUMENTS

| | | | | |
|---|---|---|---|---|
| 4,722,752 | A | 2/1988 | Steck | 134/25.4 |
| 4,787,825 | A | 11/1988 | Mantell | 417/395 |
| 4,854,832 | A | 8/1989 | Gardner et al. | 417/395 |
| 4,902,350 | A | 2/1990 | Steck | 134/1 |
| 4,904,167 | A | 2/1990 | Eickmann | 417/395 |
| 4,981,418 | A | 1/1991 | Kingsford et al. | 417/63 |
| 5,062,770 | A | 11/1991 | Story et al. | 417/375 |
| 5,261,798 | A | 11/1993 | Budde | 417/393 |
| 5,263,827 | A | 11/1993 | Esposito et al. | 417/395 |
| 5,326,234 | A | 7/1994 | Versaw et al. | 417/393 |
| 5,362,212 | A | 11/1994 | Bowen et al. | 417/395 |
| 5,409,355 | A | 4/1995 | Brooke | 417/395 |
| 5,466,133 | A | 11/1995 | Tuck, Jr. | 418/2 |
| 5,520,523 | A | 5/1996 | Yorita et al. | 417/387 |
| 5,527,160 | A | 6/1996 | Kozumplik, Jr. et al. | 417/46 |
| 5,540,568 | A | 7/1996 | Rosen et al. | 417/395 |
| 5,564,911 | A | 10/1996 | Santa | 417/395 |
| 5,567,118 | A | 10/1996 | Grgurich et al. | 417/393 |
| 5,649,813 | A | 7/1997 | Able et al. | 417/393 |
| 5,816,778 | A | 10/1998 | Elsey, Jr. et al. | 417/395 |

(List continued on next page.)

OTHER PUBLICATIONS

ALMATEC Maschinenbau GmbH, "Almatec One 4 All . . . " (advertisement).

ALMATEC Maschinenbau GmbH, "Corporate Profile" (advertisement).

ALMATECH Maschinenbau GmbH, "Technical Data Sheet" (advertisement).

(List continued on next page.)

*Primary Examiner*—Willis R. Wolfe
(74) *Attorney, Agent, or Firm*—Workman Nydegger

(57) ABSTRACT

A pump for ultra-pure fluids comprises a flexible diaphragm separating a fluid chamber from an air chamber. The diaphragm creates an airtight seal between the fluid chamber and the air chamber. Any leak from the fluid chamber into the air chamber is detected by a fiber optic system comprising an element and two optical fibers that are disposed such that light is detected by the second optical fiber only when the element is not in contact with liquid. A second fiber optic system can also be used to determine the stroke of an oscillating member by disposing the fiber optic lines at an angle calculated to reflect light off of the oscillating member when the member arrives at a predetermined location. The fiber optics are adapted to be resistant to corrosion, non-igniting, and non-contaminating.

31 Claims, 13 Drawing Sheets

U.S. PATENT DOCUMENTS

| | | | | | |
|---|---|---|---|---|---|
| 5,860,794 | A | | 1/1999 | Hand et al. | 417/395 |
| 6,106,246 | A | | 8/2000 | Steck et al. | 417/395 |
| 6,142,749 | A | | 11/2000 | Jack et al. | 417/395 |
| 6,152,704 | A | | 11/2000 | Aboul-Hosn et al. | 417/360 |
| 6,152,705 | A | * | 11/2000 | Kennedy et al. | 417/395 |
| 6,168,394 | B1 | | 1/2001 | Forman et al. | 417/393 |
| 6,402,486 | B1 | * | 6/2002 | Steck et al. | 417/395 |
| 2003/0012668 | A1 | * | 1/2003 | Simmons et al. | 417/395 |

OTHER PUBLICATIONS

ASTI Corp, USA, "Controlled Flow Teflon Pump" (advertisement), Oct. 1997.

"F SERIES: The world's leading pneumatic drive bellows pumps."

Nippon Pillar Packing Co., Ltd., "Circulation System For Medium Temp" (advertisement).

White Knight Pumps & Fittings, Inc. "Corporate profile" (advertisement).

White Knight. "White Knight: It just makes sense." (advertisement). Mar. 1996.

WILDEN, "The Wilden Pump—How It Works" (advertisement).

WILDEN, *Chemical Pumping Solutions* (brochure), Jan. 1997.

Yamada, "Double Diaphragm Pump F Series" (advertisement).

* cited by examiner

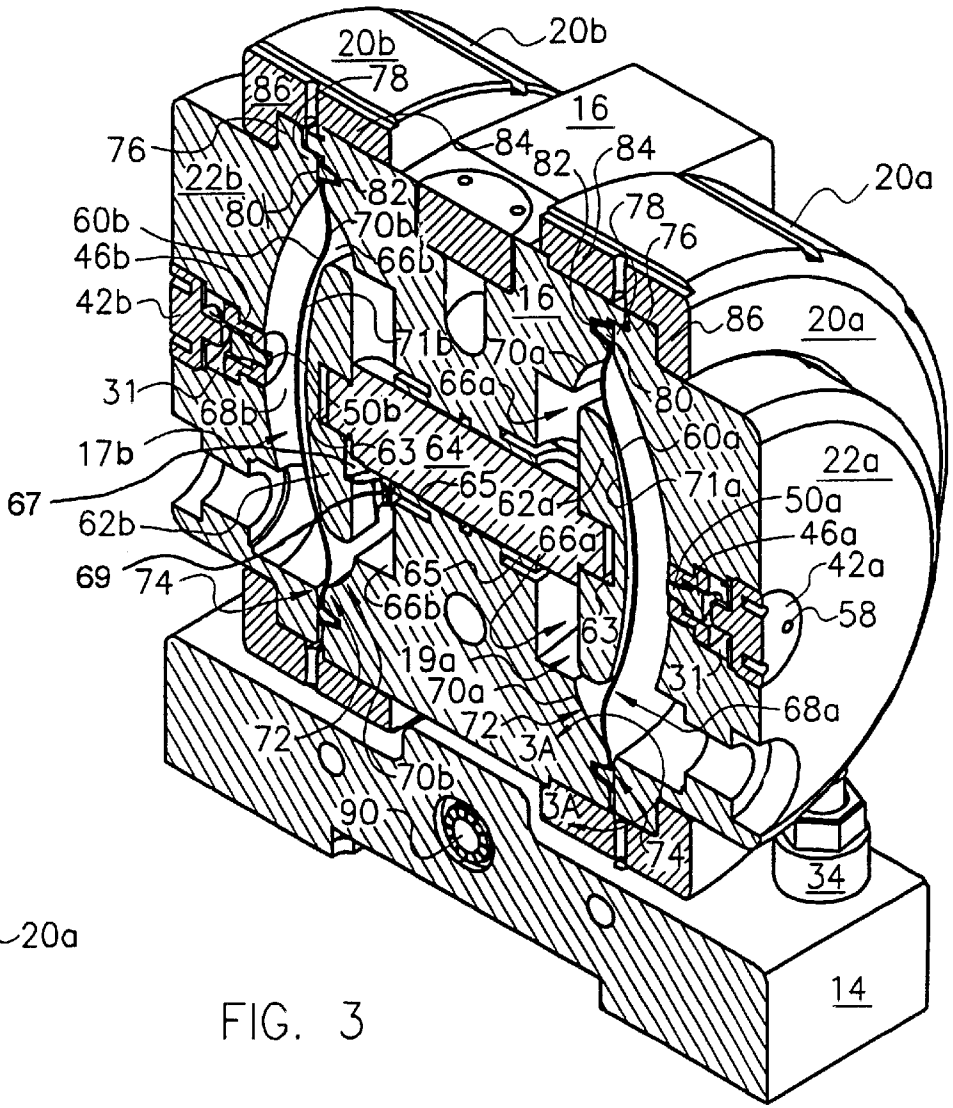
FIG. 3
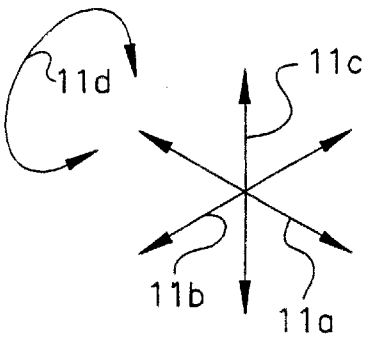
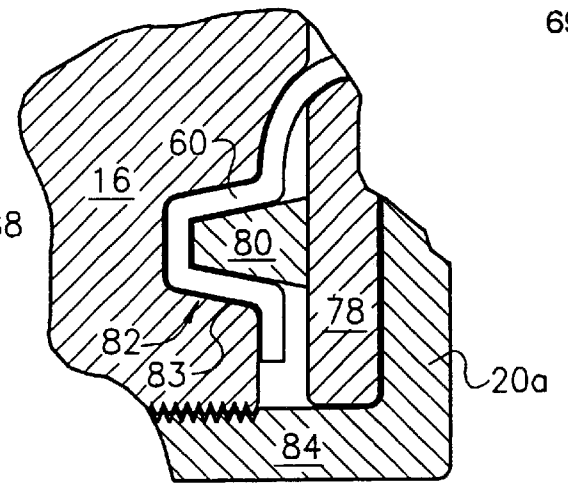
FIG. 3A
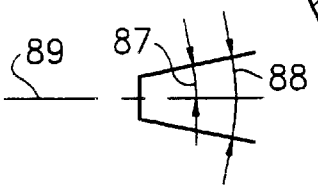

FIBER OPTICS SYSTEMS FOR HIGH PURITY PUMP DIAGNOSTICS

CROSS-REFERENCE TO RELATED APPLICATIONS

This application is a continuation-in-part of U.S. patent application Ser. No. 09/946,752, filed Sep. 4, 2001 now U.S. Pat. No. 6,402,486, entitled "Fiber Optics System for Detecting Pump Cycles", which is a continuation of U.S. patent application Ser. No. 09/642,426, filed Aug. 21, 2000, now abandoned, entitled "Free-Diaphragm Pump", which is a continuation of U.S. patent application Ser. No. 09/166,490, filed Oct. 5, 1998, entitled "Free-Diaphragm Pump", now issued as U.S. Pat. No. 6,106,246. The foregoing patents and patent applications are incorporated herein by reference.

BACKGROUND OF THE INVENTION

1. The Field of the Invention

This invention relates to components for operation in ultra-pure environments and, more particularly, to novel systems and methods for providing long-lived pumps that are metal-free, ultra-pure, non-reactive, etc. for providing environments for hot, reactive or pure, liquids at elevated temperatures, with respect to ambient.

2. The Relevant Technology

Non-reactivity is a critical function in systems managing, transporting, or relying upon fluids. Fluids include gases and liquids. Many industrial processes rely on liquids, that may damage, weaken, leach, or otherwise interact with metals, elastomeric polymers, and other common materials.

One industry that has suffered with the limited technology available to provide high purity and temperature is the semiconductor processing industry. For example, hot, de-ionized water is used in numerous processes. Impurities are measured in parts per billion. Some materials may be hot acids used in etching and cleaning processes. Transporting, holding, heating, and other procedures for managing ultra-pure water, acids, and the like, are problematic in several ways.

For example, pumps have traditionally been made of metal. Metals are commonly used in the support structures of the pumps. Regardless of the "stainlessness" of a metal, the purity requirements are not met by any known metals.

Polymers are often used for sealing members but may leach, react, degrade, or otherwise contaminate liquids. Moreover, polymers are typically not dimensionally stable. Polymers creep, stretch, yield, and otherwise become unreliable. Polymers (plastics, elastomers) respond to load, pressure, time, chemical environment, and, if any system failure occurs, may destroy any hope of reliability and "failing clean," failing to function yet leaving no contamination possible. Failures in the sealings may arise by creep or yielding of polymers. Leaks or other failures may expose materials during any failure. Accordingly, seals do not achieve perfect protection. The ability to avoid failures completely ranges from extremely difficult to impossible. Failures can be catastrophic if a system will not "fail clean."

Contaminants in trace amounts which exceed allowable limits may destroy a batch of product. Physical destruction is not required. Rendering a silicon wafer, or other high purity substrate material, unusable due to contaminant reaction with a surface can waste product output. Down time for decontamination may be even more costly in actual lost production.

What is needed is a fluid handling system that is clean to extremely high standards. All materials that may potentially contact contained fluids, even in the event of failures, should be pure and non-reactive. Materials should tolerate temperatures in the range of 1 degree Celsius to 180 degrees Celsius. In some acids, temperatures may range from 100 degrees Celsius to 180 degrees Celsius.

Thus, stability over a broad range of temperatures, reliability in service, long life under exposure to extreme of temperatures, pressure, and reactive agents, and the like must all be tolerated. Repeatability of designs, and reliable repeatability over the lifetime of all installed apparatus in the system are very desirable. Currently, the most reliable pump mechanisms still depend on elastomeric seals and metal structural supports. Pumps do not have sufficient life and do not "fail clean" in service. Upon failure, metals and elastomers are then exposed and are reactive. Thus, pumps still fail to maintain purity in failure or to operate reliably over many millions of cycles.

What is needed is a reliable, failclean, pump that operates over 10–50 million cycles, and that maintains purity, even in failure. Long term durability at elevated temperatures, pressures, and reactivities, without the threat of catastrophe at failure, is needed.

BRIEF SUMMARY OF THE INVENTION

In view of the foregoing, it is a primary object of the present invention to provide a clean, high temperature, non-reactive, repeatable, producible, reproducible, low-cost, dimensionally stable, long-lived pump.

It is an object of the invention to provide a pump that will tolerate conventional manufacturing processes while providing suitable reliability and low-cost operation and maintenance for routine installations.

It is an object of the invention to provide a pump construction that can rely on readily available materials and readily available manufacturing processes at standard manufacturing tolerances in order to maintain costs while providing reliability over tens of millions of cycles.

It is an object of the invention to provide reliable sealing in a pump, long-lived diaphragms at low cost, and a simple reliable mounting assembly that will support a fluid handling system and which will fail clean in the event of any failure.

Consistent with the foregoing objects, and in accordance with the invention as embodied and broadly described herein, an apparatus and method are disclosed, in suitable detail to enable one of ordinary skill in the art to make and use the invention. In certain embodiments an apparatus and method in accordance with the present invention may include a body and heads holding diaphragms with an associated adaptive seal. A union ring on each head may be provided, to connect to the body and to hold the diaphragm securely.

A pump may be assembled with threads. A union-type connector may hold the body and a head together. In one apparatus and method in accordance with the invention, a polymeric, preferably a fluoropolymer and non-reactive film, may form a diaphragm. The diaphragm maintains a single, substantially constant thickness without the need for changes in cross-section in order to accommodate mounting. The diaphragm may be contoured to fit a chamber so as to match the chamber wall at each end of a stroke. Accordingly, the diaphragm is fully supported when the pump is dead-headed, or backed up in a flooded or shut off position.

As a practical matter, no inflection point is required in the diaphragm during any unconstrained or unattatched point of its traverse. Hardware contact on the diaphragm is not substantial enough to cause overstressing, secondary creep, yielding or the like in the diaphragm.

The diaphragm is extremely reliable such that it becomes non-limiting in the life of the pump. Components close to the diaphragm use tight tolerances, closely matched angles, and short gaps between components. The configuration of the components provides for little unsupported material which reduces the stress within the material. No other loading is applied to the diaphragm. In the event of an air system failure, in an air-actuated pump, the high pressure applied to the diaphragm will be supported by the backing material on a chamber head or piston head. Likewise, since no buckling is required in the diaphragm, there is no change of direction and no inflection point within the chamber during operation. As a result, the life of the pump is greatly extended.

In one embodiment, the frame may be installed using a trapezoidal seal shim that produces a sharp angle bend, preferably less than or equal to 70 degrees. Thus, the diaphragms may be locked into trapezoidal slots, and held in place by trapezoidal shims, all comprising the same class of material, and preferably the exact chemically consistence or chemically identical material. Accordingly, the pump diaphragms limit any need for rim or compression seals, clamps, flanges, elastomeric seals, metals, and the like.

In one embodiment, the trapezoid may be irregular. One side may have a 70 degree angle, 20 degrees less than a right angle, and the other side may be a right angle. In another embodiment the trapezoid is regular and has a 70 degree angle, 20 degrees away from normal or perpendicular. The seal formed in a regular trapezoid becomes self centering.

The diaphragm is retained using no elastomeric materials, no rims, no metals, no flanges, no through-holes, and the like. Furthermore, the diaphragm is subjected to equalized loads. Prior art systems dealing with elastomeric materials will not fail clean. Moreover, creep is a factor in all fluoropolymers. However, geometries that can creep are adapted to conform to the seal, forming a tight mechanically adhesive load between the shim, the diaphragm, and the receiver slot for the shim.

A design after this mode prevents creation of diaphragm flange material that would pull in and increase diaphragm arc length. Increasing the diaphragm arc length tends to cause buckling or diaphragm roll at the point of flexure or the point of maximum flexure near the outer most confines of the chamber in which the diaphragm is located. Thus, even thin films of less than or equal to 30 thousands inch may be operated without buckling. Therefore, folding of the diaphragm and premature rupture of the diaphragm is avoided.

In one embodiment, a union nut is used to secure the head of the pump to the pump body or pump frame. A union nut is a slip ring having an aperture allowing the head to protrude there through away from the pump frame or pump body. The head may thus be registered, and the nut is fully free to slip circumferentially while loading the head longitudinally along the access of the driving rod between the pistons and diaphragms of the pump.

A non-reactive material, preferably a polypropylene is used to construct the entire nut. The nut applies a load to a cantilevered edge or lip of the head. Accordingly, primary creep is allowed to occur and loaded out. Thereafter, the head maintains sufficient spring properties, along with sufficient deflection under such spring properties, to maintain the minimum required loading of the head against the pump body at all times of service.

Moreover, the creep losses of thread materials and of the cantilevered head combine to permit less deflection than that required to maintain the spring loads in spite of continuing secondary creep. Therefore, head loading is maintained. The seal surface remains loaded and sealing. Pneumatic loading on the heads during actuation of the pump diaphragms is ineffective to cause excessive creep and unload the heads. Moreover, weeping, releasing chemicals, is eliminated. Moreover, compliant elastomeric seals are not required to act as energizers. Again, such a sealing system provides for a "fail-clean" failure in the event of any potential failure.

In one embodiment, the heads of the pump may be provided with leak detectors. The leak detectors may be sealed away from the fluid of the pump by a window. The window is constructed of "non-reactive" material that allows light to transmit.

In one embodiment, a thin diaphragm may be formed of polytetrafluoretheyne. In one embodiment, an anisotropic polymer is used. Moreover, in one embodiment, an expanded PTFE may be used.

Other plastics such as PFA may be used. Nevertheless, PTFE has been shown to be most effective. Moreover, by forming the diaphragm of PTFE, an amorphous fluoropolymer, a flexible diaphragm making a mechanically hermetic seal with the pump body and head (trapezoidal slot and shim) is so effective in practice that in certain circumstances minimal to no loading of the seal is required after a certain period of operational time.

In another embodiment, the leak detector utilizes an element having a selectively reflecting surface. The selectively reflecting surface reflects light from a fiber optic line when the element is in contact with air, but refracts light when the element is in contact with liquid. Thus, the a fiber optic line adapted to receive a light signal only detects the signal when the element is in not in contact with liquid.

Creep is ever present with fluoropolymers. Accordingly, threads creeping is typical when in tension and shrinking when in compression. Creep and shrinking presents a continuing problem in the use of fluorocarbons. In one embodiment, an entire pump may be assembled, with the lip on the edge of a head retained in an engagement portion of a slip ring or union nut threaded to the body of the pump.

Accordingly, creep will ensue in all components, the body, the cantilevered head portion and the slip ring or union nut. However, heat soaking and below ambient cooling under load may remove primary creep. Thereafter, the nut or union nut may be retightened on each end of the pump, maintaining dimensions within tolerances required for loading. Thus, secondary creep occurring after a heat soak and cooling cycle and loading of primary creep, is insufficient to unload the cantilevered member of the head, and thus maintains the head against the body in sealing relation.

A pump made in accordance with the invention improves operations substantially by including no metallic parts and no elastomeric parts. That is, an apparatus in accordance with the invention, is intended to "fail clean." To fail clean signifies that a failure of any component within the pump, including any sealing component, results in no contamination of any liquids by reactive materials. Reactive materials include elastomeric polymers such as Neoprene™, Viton™, Nitrile, FKM, EPDM and the like. Other reactive materials include virtually all metals. Although some metals are considered non reactive, the requirements for the purity of liquids used in the semi-conductor processing industry is so strict that even "nonreactive" metals must be considered reactive in so far that the invention is concerned.

Thus, valves in the apparatus made in accordance with the invention contain no reactive components. Two types of strike valves or end-of-stroke valves are contemplated. In one embodiment, a short-stroke valve or poppet valve may operate at the end of a stroke of a diaphragm. The diaphragm, upon reaching the limits of the displacement permitted by a head portion of the operating cavity, contacts the head dome or cavity. Accordingly, a protrusion or post on a poppet valve is contacted by the diaphragm. The poppet valve opens a channel (air channel) to communicate with the now-evacuated head chamber over the diaphragm. The poppet valve, it's actuator with a post integrally formed therewith, and a seat securable, such as threadable, to the head, may be provided.

In another embodiment, a long valve may be adapted to access the end of a stroke of a diaphragm or piston retreating away from the head and toward the body of a pump in accordance with the invention. A long-stroke, pilot valve may be designed to operate as a spool. Accordingly, a shank or shaft of the long-valve may be provided with a bumper maintained in contact with a diaphragm, such as against a diaphragm over an underlying piston head driving and being driven by the diaphragm.

The spool shaft, shank, tang, etc. thus extends into the chamber until the piston and diaphragm are halted by stops. Thereafter, chamber pressure may bleed through ports in the pilot valve to shift operation of the pump, by reversing the stroke. The spools may be designed as known in the art to use the main shaft, having a circumferentially extending channel, with cylindrical bearings passing over ports. Accordingly, bearings may selectively expose ports to circumferential channels, thus altering a position of the spool and subsequent channeling of flows between ports in a main housing surrounding the spool.

In one embodiment, only machined surfaces of nonreactive materials act as sealing surfaces. Additional wear may occur due to a lack of hardness, durability, abrasive-resistance, and the like. Nevertheless, nonreactive polymers maintain low core frictions with one another in certain embodiments. Moreover, any particulates from galling, wear, abrasion, fretting, and the like will nevertheless remain nonreactive. Accordingly, filters and traps within flow lines may typically remove such particulates, and the presence of such particulates will not cause leaching of contaminating ions into pumped fluids.

In one embodiment, no elastomeric seals are used in any valve, including principal check valves checking against back flows into the double chambers of the pump. Machined surfaces serve as sealing surfaces, and relief or clearance is provided in each circumstance where needed in order to maintain loads, tolerate secondary creep, following heat soaking primary creep out, such that loading and deflection requirements for sealing are maintained.

Metal springs are used in certain devices. Likewise, elastomeric seals, such as face seals or "O" rings and the like are often used in prior art systems to form seals. Downtime, lost processing batches, and the like are very expensive propositions. Accordingly, a fail clean system made in accordance with the invention relies on no metal springs, no metal washers, no metal retainers, and no metal of any kind. The fail clean system further does not rely on reactive, or organic materials exposed to operating fluids (gases, air) nor the transferred fluids (DI water, acids, hot acids, etc.). Any possible contact between the air chamber, or the liquid chamber in the pump (of which the pump has two of each, typically) eliminates all contact even in the air chamber with metals and elastomers.

In one embodiment of an apparatus and method in accordance with the invention, a base mounting system may be used for integrating a controller with a pump. Air controllers may be external and may be remote from a pump. However, mounting a pump is often problematic. Accordingly, a base is provided in which fluid conduits of the pump are formed to become the legs connecting a pump for mechanical support to a base. Meanwhile, the entire air controller mechanism may be formed in the base. Alternatively, the base may simply pass air through the pump from an external controller, depending on a users selection.

Several types of air control systems exist. A recirculating air system does not use high pressure. A high duty cycle is typical. Duty cycles bordering on 100 percent over many days may exist. Such a recirculating control system may operate non-stop indefinitely. An external control apparatus relies on a third party to connect a speed control to a pump installation. The third-party speed control dictates the amount of air flow to actuate a pump. Accordingly, reducing volume or pressure of incoming, driving air can be used to decrease the speed of operation of the pump. Thus, decreased displacement may be obtained directly by an external control.

A third type of control module may be a distribution unit. A distribution unit may operate under control of controlling mechanisms within the base. However, as a distribution unit, a pump in accordance with the invention may be dead-headed against a closed line. Thus, the entire pressure of the pump may be brought to bare against the pump and conduit system. A modular air pump may be made externally removable. However, a mount in accordance with the invention may be used for either recirculating air, external air vented to atmosphere after actuation of a cycle of the pump operation, or a distribution unit in which air is recirculated but the pump may be dead-headed against a closed line. A mount may provide a platform adapted to a universal pump. Adapted to different bases for control schemes.

By providing the opportunity for an external air system to mount to the base, the air logic transfer passages may be connected to the pump body directly from the external control system without the use of elastomeric seals. The base is symmetric about its air logic porting. One may note that externally controlled systems theoretically produce no contaminates that could be received into a system. Nevertheless, the pump in accordance with the invention is provided with rapid discharge of all controlling air overboard.

The air logic system is isolated, on the one hand, from the pump, on the other hand, the air logic and air connection system is easily removable and serviceable. Moreover, a clamping block may be inserted laterally into the base, to be locked against the base, maintaining the pump in position. The logic and connection system are easily serviceable in such a package, especially when provided with quick-release capability. Likewise, fluid systems need not be opened in order to conduct air system repairs or service. Since the material in the lines and the pump chambers for liquid is ultra pure, elimination of any possible contact of elastomers, metals, or the like.

A spool valve actuated by a pilot valve detecting the end of a stroke of a diaphragm may be implemented to control the speed and the return of a piston driving or being driven by a diaphragm. However, spool valves may be somewhat treacherous. Spool valves typically receive a signal from one line, and they try to equilibrate that signal at some point. For example, at the end of a stroke, the pilot valve cannot move, and air ported through the pilot valve accumulates in a location. As the pressure in a specific location rises, it may act in an axial direction (transversely with respect to an axis of the driving shaft on the pistons) to shift the position of the spool or shuttle. Stabilizing shifting pressure at a specific location has traditionally been difficult.

A detent or bias mechanism may be implemented in accordance with the invention. Previous diaphragms have typically been frameloaded. For example, in flange-mounted diaphragms, a widely varying range of pressures results in shifting a spool or shuttle. Overcoming friction and the like may provide unreliable forces. In an apparatus and method in accordance with the invention, a snap disk is positioned to a collar and shaft of a spool. A disk is maintained in a cavity restricting the diameter thereof. Nevertheless, longitudinally, with respect to the shuttle or spool, the detent is free to move.

The detent is free to move axially, with respect to the spool or shuttle within a gap freely. However, the detent must break over a center in order to change position between a first biased position deflected in a first direction and a second biased position deflected in a second opposite direction axially with respect to the spool. Moreover, the detent may be made of a particularly stiff material rather than a softer, more flexible elastomeric material. The effect of the more rigid, stiff, radially-constrained, axially-free bias detent is to provide a strict, digital motion of the spool at a narrowly repeatable pressure change.

In keeping with a virtually absolute prohibition against a metallic or otherwise reactive materials in the air path and the liquid path of a pump in accordance with the invention, a rapid exhaust valve is provided. Again, rather than common elastomeric materials, a thin, comparatively rigid, stiff film is provided. A disk of the film may be on the order of less than 0.010 inches in thickness. The dump valve or quick exhaust valve is included to divert rather than return controlled air.

For example, a circulating air control is returned to a prime mover. However, external control systems use ambient air, that is discharged after one use. Thus, a plastic disk is provided that deflects to permit passage of air around it's exterior perimeter and yet to close down against a port at near the center thereof and on the opposite side thereof in response to an airflow in the opposite direction. Thus, a very rapid dump around the exterior parameter of the disk may be conducted, yet no back flow into the lines can occur at any significant rate or total amount.

In one embodiment, a chamber holds the disk. The disk is supported on a grid on one side with fluted walls providing a standoff distance between the outer most radius of the disk and the outer most radius of the containing chamber. Accordingly, air may pass around the disk. The disk is mounted to press against a face of a port occupying an area very near the center of the disk on one side. During venting, air may pass out of the port against the disk, deflecting the disk and passing around the outermost circumference of the disk. By contrast, any pressure of air against the disk from an opposite side nearly forces the entire disk back against the port, sealing the port off against backflow.

A leak detection scheme may rely on fiber optics. In one embodiment, the leak detectors may include a body containing fiber optic lines disposed at an angle calculated to produce reflection of a beam from one fiber optic line to a receiving, second, fiber optic line, only in the presence of liquids. The difference in refractive indices of air and liquids common to processing in the semiconductor industry is sufficient to detect the presence of liquids in the air chamber actuating the piston.

In one embodiment, the fiber optic lines may be sealed against liquids for direct contact with the chamber of the pump. In another embodiment, a separate window may be provided having a very thin thickness, and formed of a material that is likewise non-metallic, high purity, non-electrical, nonreactive, and sealed. In such an embodiment, an acrylic fiber may be used. Acrylic fibers will absorb more deflection during handling.

By contrast, fiber optics may tend to break when mishandled, such as by being bent on too tight a radius. It is important to protect operators from being sprayed by exhaust or by controller exhaust when an external controller is used to operate a pump in accordance with the invention. In such an environment, a chamber filled with fluid, may be evacuated by the continuing operation of an external controller, unresponsive to the leak. In one presently preferred embodiment, a window completely seals the chamber from the leak detector, as an acrylic, fiber optic line may be used.

The double-line design is superior to prior art systems and other technologies wherein fiber optic lines are laid side-by-side in order to cooperatively send and receive a beam. The difficulty with such embodiments often includes an inability to define a digital location at which reflected light intensity indicates either a liquid is present or that an end of stroke of the pump has been reached. By using off-axis orientations between the sending and receiving fibers, the index of refraction or the presence of a film layer creates a dramatic, even digital demarcation between a desired condition and an undesired condition.

In one embodiment, a leak detector may be located near an outer circumference of a chamber in which a diaphragm is operating. In such an embodiment, another fiber optic may be positioned centrally or elsewhere within an air chamber in order to identify an end of a stroke by the pump. Accordingly, an external controller may use a fiber optic detector for the end of the stroke of the diaphragm of the pump.

In one embodiment, the end of stroke detector includes first and second fiber optic lines configured such that light reflects at an angle from an oscillating member, such as the diaphragm or shuttle valve. Light is detected by the second fiber optic line only when the oscillating member is at a predetermined displacement from the fiber optic lines.

For example, as in parallel lines that become retroreflective, a pre-determined angle may be established between two, separate, cooperative fiber optic lines. The difficulty of establishing a value or trigger lever for the reflected light from a sending fiber to a receiving fiber is eliminated by the construction in accordance with the invention. Rather, the range of distance within which a diaphragm positioned to reflect light from the sending fiber to the receiving fiber may be adjusted within a very narrow range. The narrowness of the range is sufficiently precise to be effective for operational functionality of the pump.

The signal corresponding to the reflection of light quickly decays to a minimal value far from that corresponding to a trigger position. Whenever the diaphragm moves away from a specific location designed for the sensor. Thus, a detector in accordance with the invention provides a digital signal rather than an analog signal, for all practical purposes with respect to detecting the end of stroke for controlling the operation of the pump.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which:

FIG. 3A is a sectioned, side, view of a portion of the pump illustrated in FIG. 3;

DETAILED DESCRIPTION OF THE PREFERRED EMBODIMENTS

It will be readily understood that the components of the present invention, as generally described and illustrated in Figures herein, could be arranged and designed in a wide variety of different configurations. Thus, the following more detailed description of the embodiments of the system and method of the present invention, as represented in FIGS. 1 through 11, is not intended to limit the scope of the invention. The scope of the invention is as broad as claimed herein. The illustrations are merely representative of certain, presently preferred embodiments of the invention. Those embodiments will be best understood by reference to the drawings, wherein like parts are designated by like numerals throughout.

Figure 1:
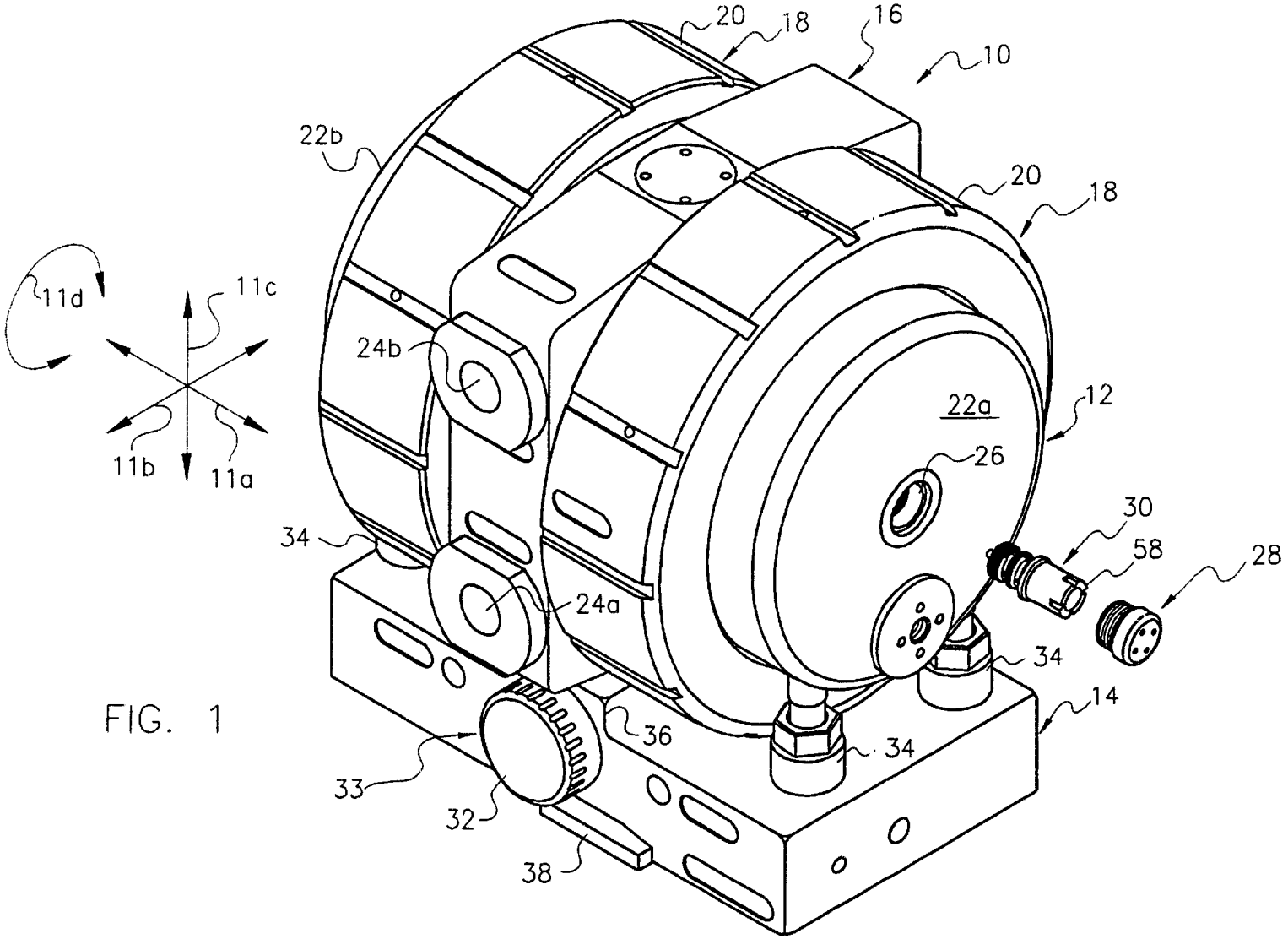
FIG. 1 is a front quarter perspective view of a pump in accordance with the invention.

Referring to FIG. 1, an apparatus 10 for pumping a transfer fluid such as hot, deionized water, etching acids, or the like may be formed of components manufactured of exclusively of nonreactive, non-contaminating materials. In one embodiment, an apparatus 10 may be oriented to have a longitudinal direction 11*a*, a lateral direction 11*b*, a transverse direction 11*c*, and a circumferential direction 11*d*. The apparatus 10 comprises a pump 12 and a supporting apparatus 14, such as a controller 14 or base 14. In one embodiment, the controller 14 and base 14 may be integrated into a single component. As a practical matter, a controller 14 may be separate, distinct, remote, and external with respect to a pump 12. Also, a base 14 may be manufactured to attach securely to a body 16 of a pump 12. However, in one presently preferred embodiment, the pump 12 is integrated into a controller/base 14 all integrated into a monolithic unit. Thus, installation, control, integrity, valving, porting, fluid communications, and the like may be factory-integrated for an improved reliability. Moreover, contamination may be reduced, and the opportunities to damage or alter equipment upon installation are reduced. Moreover, the sealing technologies appropriate for operating with such nonreactive materials as fluoroplastics, creep-prone materials, may be implemented in the manufacturing assembly of the entire apparatus 10 as a pump 12 and controller/base 14 with accompanying interconnection.

The body 16 of the pump 12 may be referred to also as a frame. In one embodiment of an apparatus 10 in accordance with the invention, the body 16 replaces external frames, through-bolts, metallic connections, and the like. As a result, the apparatus 10 results in a very compact envelope having the features of reliable design, creep-insensitivity, durability, extremely long life, fail clean operation, and completely sealed fluid paths. The life of the apparatus 10 may exceed 10 million cycles. As a practical matter, units may be designed to exceed 20 million cycles, 30 million cycles, 40 million cycles, 50 million cycles, and 100 million cycles of the pump with no operational failure of any component. This is particularly important with respect to moveable components within the apparatus 10.

Figure 2:
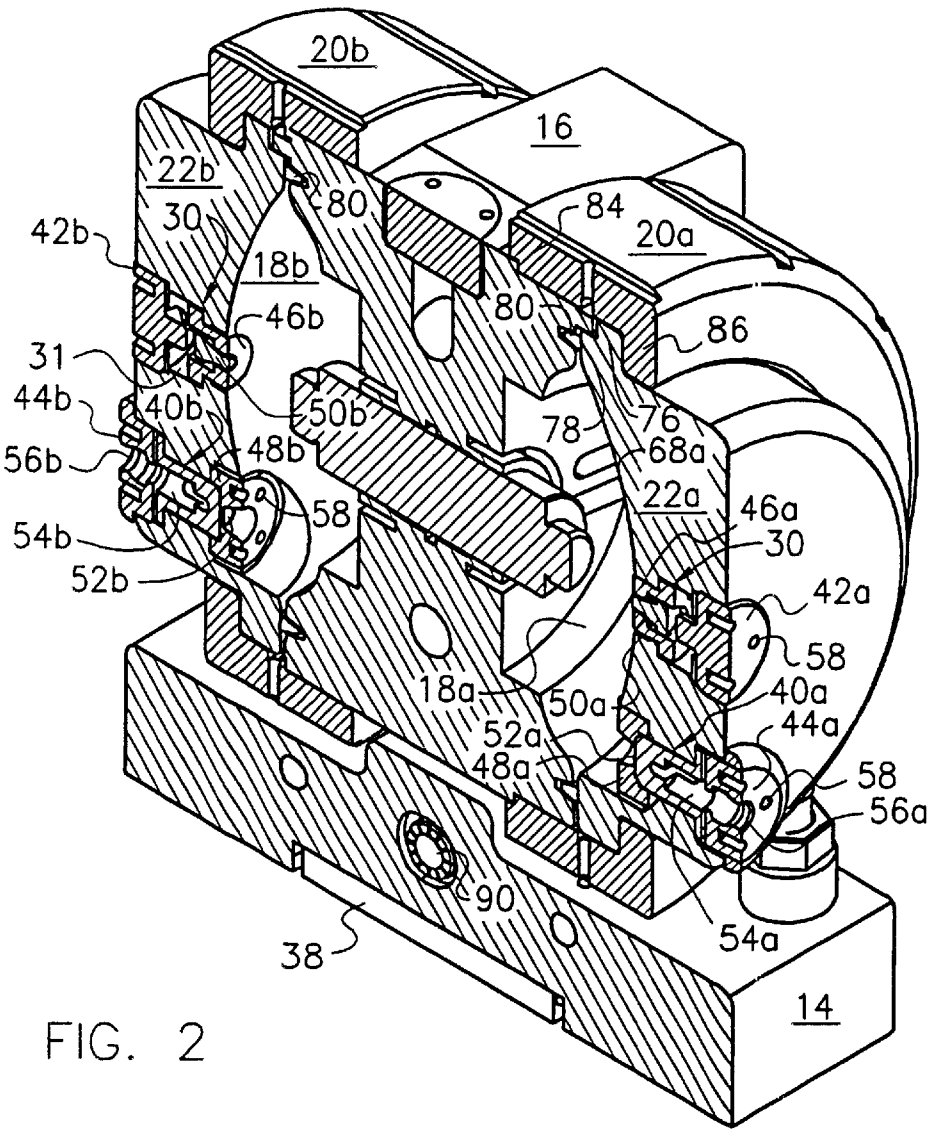
FIG. 2 is a sectioned, perspective view of one embodiment of a pump in accordance with the invention.

The pump 10 may be configured to contain two chambers 18. With reference to FIG. 2, the chambers 18*a*, 18*b*, are shown. The chambers 18*a*, 18*b* are simply specific instances of a generic chamber 18. Hereinafter, trailing alphabetical references refer to specific instances of those items to which leading reference numerals refer.

Figure 4:
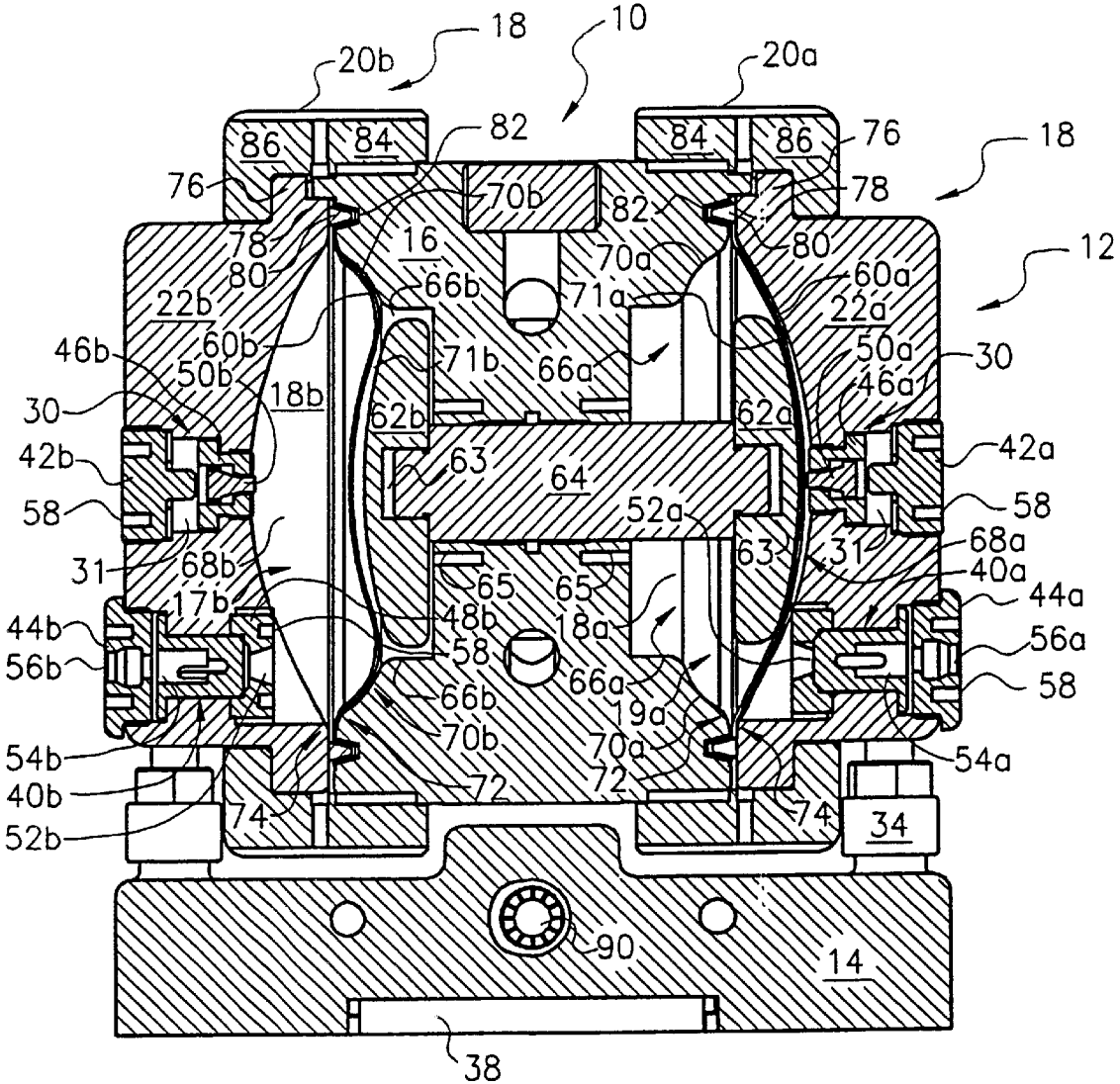
FIG. 4 is a sectioned, side, elevation view of one embodiment of a pump in accordance with the invention.

Referring again to FIG. 1 and also referring generally to FIGS. 2–4, the pump 12, may be manufactured to have slip rings 20 or union rings 20. As a practical matter, alignment of the heads 22 with the frame 16 or body 16 is problematic in many designs of prior art pumps. Various notches, alignment marks, pins, and the like may be used to align the heads 22 with the frame 16 or body 16. However, once aligned, each of the heads 22 may remain aligned with the body 16, uninfluenced by the slip rings 20 as to alignment in a circumferential direction 11*d*.

The slip rings 20 move circumferentially 11*d* with respect to the heads 22. Accordingly, the heads 22 remain fixed with respect to the body 16 in a circumferential direction 11*d*. By contrast, the slip rings 20, in rotating in a circumferential direction 11*d* may thread onto the body 16, drawing the heads 22 longitudinally 11*a* closer in a sealing relationship with the body 16. The slip rings 20 may thus be tightened to any particular loading, particular for heat soaking to relieve primary-creep. In one embodiment, the slip rings 20 may be tightened to a design load tolerated by threads associated therewith, in order to seal the heads 22 against the body 16. Thereafter, the pump 12 may be heat soaked in order to accelerate primary creep. Thereafter, the slip rings 20 may be tightened with no circumferential 11*d* displacement of the heads 22. Accordingly, tightening the slip rings 20 against the body 16 at a load and displacement effective to render the apparatus 10 subject only to secondary creep is easily trackable.

Ports 24*a*, 24*b* may form an inlet 24*a*, and outlet 24*b*, respectively. Within the body 16 may be many suitable arrangements of check valves providing biasing of flows through the pump, preventing backflow. Double, serial check valves may provide a rectifier for the fluid flow from the inlet 24*a*, through the chambers 22, to the outlet 24*b*.

In one embodiment, an aperture 26 may be formed in one end of the head 22. A retainer 28 may be provided to thread or otherwise fasten to the aperture 26, securing a pilot 30 or end-of-stroke detector 30. The pilot 30 may be configured to detect the end of a stroke of the pump 12 for operation of a piston near the detector 30 or remote from the detector 30. The pilot 30 may be used to signal the controller 14 in order to switch the direction of an operating fluid driving the pump 12. According to the flows of operating fluids into the pump 12, the transfer fluid being conducted through the inlet 24*a* and outlet 24*b* may be appropriately driven and directed through the pump 12.

In one embodiment, a retainer 32 may fit an aperture 33 in the base 14. The retainer 32 may capture the components of the controller 14 within the base 14. Accordingly, an aperture 33 may be adapted to extend an appropriate distance as needed in order to support the proper valving, porting, control mechanisms, and the like of the controller/base 14.

In one presently preferred embodiment, mounts 34 connecting the base 14 to the pump 12 may actually integrate fittings. Thus, the mounts 34 or line fittings 34 may extend from the base 14 to the pump 12 for conducting fluids thereto. In one presently preferred embodiment, the mounts 34 are the basic lines 34 conducting operating fluid from the controller/base 14 into the heads 22 for driving the pump 16. In one presently preferred embodiment, certain portions of the controller/base 14 may be disposed within a pedestal 36. Moreover, the pedestal 36 may be adapted to fit against the frame 16 or body 16 of the pump 12. Accordingly, the pedestal 36 may assist in the mounts 34 in supporting the pump 12 and restricting the motion thereof.

Referring again to FIG. 2, and continuing to refer generally to FIGS. 1–4, a latch block 38 may be provided for securing the controller/base 14 onto a support surface. The latch block 38 may be configured to engage the base 14 in any of a variety of methods for secure and convenient mounting.

A leak detector 40 may be provided in the heads 22. In one embodiment, a fiber optic 40 may also be used as an end-of-stroke detector 30. The pilot 30 or end-of-stroke detector 30 of FIG. 1, in one embodiment, may be a pneumatic and mechanical apparatus. In the embodiment of the detector 40, an optical detection mechanism may be implemented to detect the end of a stroke of the pump 12.

A pilot 30, illustrated in FIG. 2 as a short version for detecting an end of a stroke near the head 22, as opposed to the detector 30 or pilot 30 of FIG. 1, adapted to detect an end of stroke remote from the head and close to the body 16, may be captured by a retainer 42. Similarly, a leak detector 40 may be captured by a retainer 44. The body 46 of the pilot 30 may thus be secured by sealing, wedging, threading, or the like into the head 22. As a practical matter, certain pressurization of materials within the head, may form all sealing surfaces with respect to the body 46. Accordingly, the retainer 42 may apply a force to the body 46, forming a seal and maintaining loads on the seal. In another embodiment, the body 46 may be threaded directly into the head and forming a seal therewith.

A mount 48 for a leak detector 40 may be positioned within the head 22. In one embodiment, the mount 48 may be threadedly engaged into the head 22. By contrast, the actuator 50 of the pilot 30 is free to move longitudinally 11*a* with respect to the pump 12 and head 22.

The mount 48 of the leak detector 40 may be fabricated to include or support a window 52. In one embodiment, the window 52 is adapted to be formed of a material identical to that of the head 22. Accordingly, material compatibilities, creep, sealing, and the like may all be accommodated readily between the materials of the head 22 and mount 48. Meanwhile, the mount 48 can be machined to formed a very thin window 52 adaptable to be translucent or transparent to light. Thus, a reflective beam from and returning to the leak detector 40 may pass through the window 52 into the chamber 18, and back to the leak detector 40 for pickup or reception.

A cavity 54 or slot 54 may be provided within the leak detector 40 in order to accommodate passage of electronic or fiber optic lines. In one embodiment fiber optics are used up to the window 52. Accordingly, the slot 54 may be used to adapt fiber optic lines to fit with their accompanying sheathings through the retainer 44 to the required proximity to the window 52. A channel 56 may be provided through the retainer 44 in order to conduct such lines to a proper control center for interpretation and actuation with respect to any signal detected by the leak detector 40. In one embodiment, profiles may be maintained in a minimum envelope by providing tool holes 58 adapted for rotating circumferentially 11*d* the retainers 42, 44. As a practical matter, substantial force may be developed by application of circumferential 11*d* loads on metal prongs adapted to the tool holes 58. Thus, less material, a cleaner profile, less chance of damage, and the like may be provided by use of the tool holes 58 to operate the retainers 42, 44.

Referring to FIGS. 3–4, and continuing to refer generally to FIGS. 1–2, as well, diaphragms 60 may be disposed within the chambers 18 of the pump 12. The diaphragm 60 may be any isolation medium which is used to separate fluids such as drive fluids from working fluids. In one embodiment, a driver 62, or plate 62 may be thought of as a piston 62 for communicating force or pressure between corresponding diaphragms 60*a*, 60*b*. An aperture 63 may be formed in driver 62 or piston 62 in order to accommodate a shaft 64 operably connecting the drivers 62*a*, 62*b*. The shaft 64 may travel through a barrel 65 formed in the body 16 of the pump 12. The barrel 65 may be received, as illustrated, in order to minimize stress, and permit natural alignment of the drivers 62, shafts 64, and surfaces of the barrel 65 in the frame 16.

A recess 66 may be provided in the body 16 as a cavity 66 for receiving each of the drivers 62. In one embodiment, the recess 66 permits improved support of the diaphragms 60 in operation. More particularly, the recess 66 permits the minimization of any gaps between the body 16 and the driver 62 from leaving unsupported any substantial area of the diaphragm 60. For example a contoured surface 68 formed in the head 22 may support the diaphragm 60 along its entire operational area. Similarly, a contoured surface 70 of the body 16 may be adapted to transition smoothly and snugly from the driver 62. Accordingly, the diaphragm 60*b* positioned against the body 16 and the driver 62*b* may be completely supported even against the dead headed load, a stalled line, or a backflow in a line from which the pump has been shut down. Thus, whether position against the contoured surface 68 of the head 22 or against the contoured surfaces 70 of the body 16 and 71 of the drivers 62, the diaphragm 60 is completely supported.

In one embodiment, as shown in FIG. 3, the driver 62 may be configured with a collection chamber 67 for fluid. The collection chamber 67 accumulates fluids as the driver 62 approaches against the body 16. The driver 62 is further configured with a relief passage 69 for venting the collection chamber 67, thus avoiding pressure buildup. Otherwise pressure buildup may distort components and reduce pump life.

An edge 72 or curvature 72 at an edge of a the body 16 may be smoothly transitioned to reduce or eliminate sources of stress concentrations in the diaphragms 60 in operation. For example, the curves 72 in the body 16, and curves 74 in the heads 22, provide for flexure of the diaphragm 60 in either longitudinal 11*a* without production of stress concentrations and without stretching or folding of the diaphragm 60. In one presently preferred embodiment, all edges or corners of the body 16, driver 62, and head 22 of a pump 12 in accordance with the invention, are adapted to have curvatures 72, 74 and clearances configured together to provide minimization of stress with virtual elimination of strain within the diaphragms 60. Thus, unsupported spans are minimized by appropriate selection on clearance between components, such as between the driver 62 and body 16 with appropriate curvatures further reducing the probability of stress concentrations occurring.

In one presently preferred embodiment, a head 22 may be fabricated to have a cantilever 76. A cantilever, may be thought of as a flange, but does not operate as a flange, as that term is typically used. No through holes are appropriate in one presently preferred embodiment of a cantilever 76. Rather, the cantilever 76 merely forms a plate 76 or skirt 76 extending radially 11*b*, 11*c* away from the chamber 18 formed by the head 22 and body 16. Cantilever 76 is preferably never in contact with the body 16.

Referring to FIG. 3A, a driver 78 is shown which comprises a wedge 80 which is adaptable to fit into the cavity 82 of the body 16 for gripping and sealing the diaphragm 60 between the driver 78 and the body 16. The driver 78 may be contiguous and integral with the wedge 80. However, in another embodiment, the wedge 80 may be a separate ring having a trapezoidal cross-section. The trapezoid may be regular or irregular. In one presently preferred embodiment, the trapezoidal cross-section of the wedge 80 is exactly symmetrical in order to provide self-centering and equalization of loading. Thus, loading applied by the engagement portion 84 of the slip ring 20*a*, which is transferred from the driver 78 of the head 22 to the wedge 80, may be immediately transferred evenly by the wedge 80 to the diaphragm 60 and to the walls 83 of the cavity 82 in the body 16.

In one presently preferred embodiment, the wedge 80 may be a separate, distinct, and freely movable piece, with respect to radial (the plane of the lateral 1*b* and transverse 11*c* directions) motions. Thus, no binding may occur to interfere with the wedge 80 evenly distributing forces into the cavity 82 of the body 16. In one presently preferred embodiment, an engagement portion 84 of the slip ring 20 or the union nut 20 may threadedly engage the body 16. Accordingly, the turning of the slip ring 20 may draw the head 22, and particularly the cantilever 76 toward the body 16 longitudinally 11*a*. The lip 86 of the slip ring 20 engages the cantilever 76 to drive the cantilever 76 in the longitudinal direction 11*a*. Accordingly, the driver 78, preferably integral to the cantilever 76 and head 22 drives the wedge 80 longitudinally 11*a* into the cavity 82.

Continuing to refer to FIG. 3A and generally to FIGS. 1–4, the wedge 80 may form a half angle 87 of approximately 15 degrees or a full angle 88 of approximately 30 degrees with respect to an axis 89. An axis 89 may be an axis of symmetry 89. However, in one embodiment, the wedge 80 is an irregular trapezoid having only one side tapered with a half-angle 87. However, in one presently preferred embodiment, the wedge 80 has been found to be operationally superior with a symmetric form 88.

Referring to FIG. 3 and generally to FIGS. 1–4, operation of the diaphragms 60 is controlled by a flow of operating fluid, such as air from the controller/base 14 into the chambers 18 toward the heads 22. Accordingly, the chambers 18 pass a transfer fluid being pumped into and out of the chamber 18 between the diaphragms 60 and the body 16. The flow of air in the controller 14 is effected by a shuttle valve 90 or spool valve 90 triggered by the pilot 30.

Sealing the chamber 18 into two portions 17, 19 is effected by the diaphragm 60 in conjunction with the wedge 80. The portion 17 is formed by the diaphragm 60 in the head 22. The portion 19 or chamber 19, is formed by the body 16 and the diaphragm 60. The volume of the respective chambers 17, 19 or portions 17, 19 of the chamber 18 fluctuate. Thus, each 17, 19, in turn, occupies the majority of the chamber 18. The seal is effected by the force applied by the driver 80 of the head 22 against the wedge 80, pinning or capturing the diaphragm 60 between the wedge 80 and the surface 83 of the cavity 82.

The wedge 80 has been found so effective that a calendered fluoropolymer in a fluorocarbon body 16 and head 22 had been found to form a seal that is dramatically integral even after removal of any loading on the wedge 80. Thus, a mechanical, but intimate bond, gas-tight is created between the wedge 80, the diaphragm 60, and the surface 83 of the cavity 82 in the body 16. Due to the presence of the cantilever 76, loading is maintained. Nevertheless, the sealing effect is superior, and requires no metallic, elastomeric, or other reactive components at any location in order maintain the loads and the seals effective to seal the pump 12.

Figure 5:
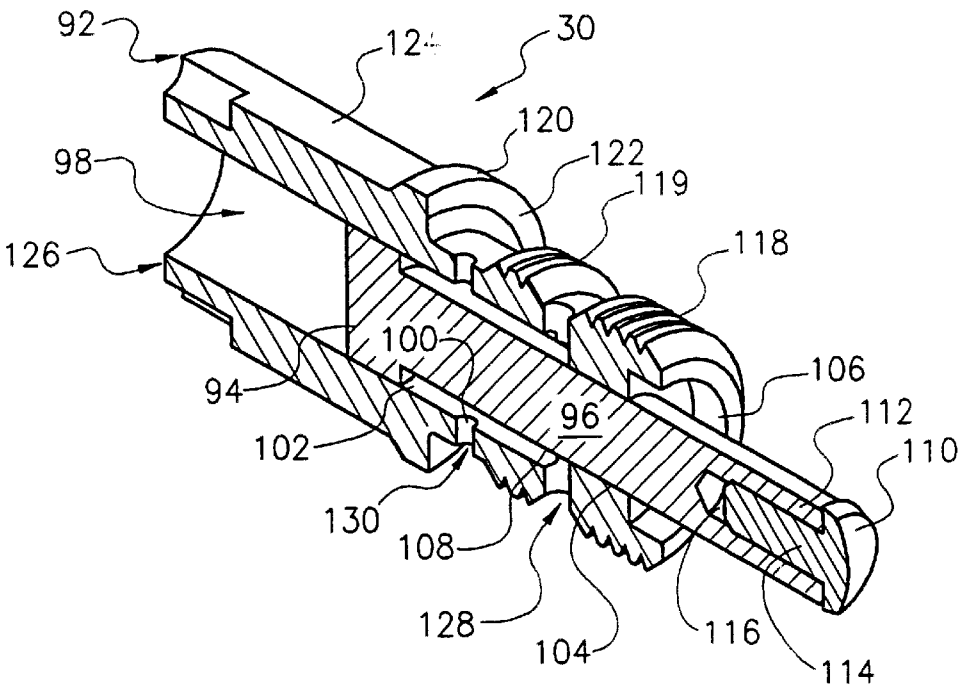
FIG. 5 is a sectioned, perspective view of a long, end-of-stroke, control valve for operation in an apparatus in accordance with the invention.

Referring to FIG. 5, and generally to FIGS. 1–6, a pilot 30 may be formed to have an element 92 adapted to be inserted in a head 22 under a retainer 42. The element 92 may form a body 92 containing a piston 94. The piston 94 may operate similarly to a spool. A shaft 96 may provide both alignment and sealing functions.

In one embodiment, a chamber 98 may be formed in the element 92 for containing a fluid. A vent 100 may be provided between the vented portion 102 or vented chamber 102, that is contiguous with the chamber 98, except for the presence of the piston 94. Thus, the piston 94 and a bearing surface 104 or sealing surface 104 may form the vented chamber 102.

The sealing for the fluid flows is provided by the piston 94 against the element 92, and the shaft 96 against the sealing surface 104. Relief 106, 108 may be provided as appropriate. Thus, manufacturing tolerances may be provided, while binding is eliminated. For example, fastening may tend to warp and bind components.

In one embodiment, the shaft 96 may be provided with a bumper 110 adapted to make contact with a diaphragm 60 against a face 71 of a piston 62. The bumper 110 may be adapted to fit a hollow portion 112 of the shaft 96. A shank 114 may fit into an aperture 116 in the hollow portion 112 of the shaft 96. Accordingly, the bumper 110 may be secured thereby to travel securely with the shaft 96. Thus, the bumper 110 may provide stress distribution, abrasion resistance, and the like so as to minimize any deleterious affect by the shaft 96 on the diaphragm 60. The shafts 96 may thereby follow the diaphragm 60 and piston 62 for detecting the end of the stroke of the piston 62 at the body 16, rather than at the head 22.

Threads 118, 119 may be formed in the element 92 or body 92 of the pilot 30 of FIG. 5. A shoulder 120 may be adapted to stop the element 92 at an appropriate location in the head 22. In one embodiment, a face 122 may abut a corresponding base in the head 22. The wall 124 of the element 92 may be secured within a retainer 42 as illustrated in FIG. 1. A face 126 may be driven or loaded by the retainer 42 thereagainst.

In operation, a passage 128 is formed between the element 92 and the head 22. The passage 128 conducts fluid, as with a spool valve. Likewise, a passage 130 provides communication of the operating fluid (e.g. air) between the chamber 102 and a low-pressure area. Thus, the chamber 98 may be loaded with chamber pressure of the pump 12, until the piston 94 passes a port 100 into the channel 130. Thereupon, the pressure in the chamber 98 may be vented throughout the port 100, indicating that the end of a stroke has been reached.

Figure 6:
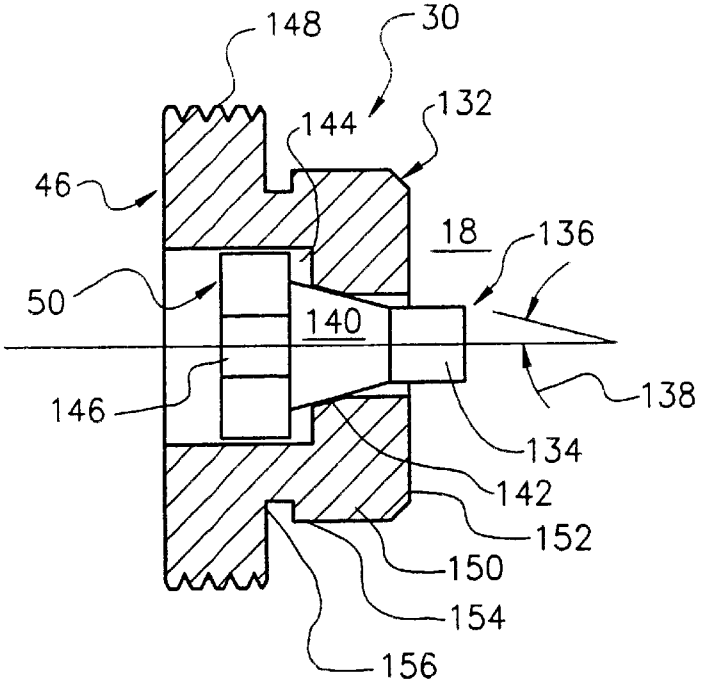
FIG. 6 is a partially sectioned side, elevation view of a valve for use as a pilot or end-of-stroke valve detecting proximity of a diaphragm to the head, in contrast to the valve of FIG. 5 for detecting proximity of the diaphragm to the body of a pump in accordance with the invention.

Referring to FIG. 6, and continuing to refer generally to refer to FIGS. 1–5, an element 132 of a short pilot 30 is illustrated. The pilot 30 may include an actuator 50 provided with a standoff 134 or post 134 extending into the chamber 18 associated with a head 22. The posts 136 and actuator 50 are preferably made from a material, as all materials within the pump 12 and base/controller 14 that are nonreactive, chemically compatible with one another, and non-contaminating, in order to be fail-clean in the event of any failure of the apparatus 10.

The post 134 may be provided with a face 136 adapted to contact a diaphragm 60 when the diaphragm 60 approaches or contacts the surface 68 of a head 22. In one embodiment, the diaphragm 60 may push the face 136 of the post 134 flush with the surface 68 of the head 22. Accordingly, the actuator 50 is freed to move the actual poppet 140 portion or valve portion 140 away from the seat 142, exposing and opening the cavity 144 to pass operating fluid there through. The operating fluid (e.g. air) passes from the chamber 18 through the passage 144 between the poppet 140 and the seat 142, to be discharged through the vents 146 in the sides of the actuator 50.

A threaded portion 148 of a body 46 may secure an insert portion 150 within the head 22. The face 152 may preferably be positioned near the contoured portion 68 of the head 22. In one embodiment, the face 152 may be substantially flush therewith. In any event, the face 136 of the post 134 may protrude sufficiently to permit complete opening of the cavity 144 by movement of the post 134 by the diaphragm 60 and piston 42.

In one embodiment, the body 46 may be provided with a shoulder 154 and relief 156 to assure clean and complete engagement by the head. The shoulder 154 may be straight or tapered with respect to the head. The shoulder 154 will maintain a virtually gas-tight seal with the head 22.

Figure 7:
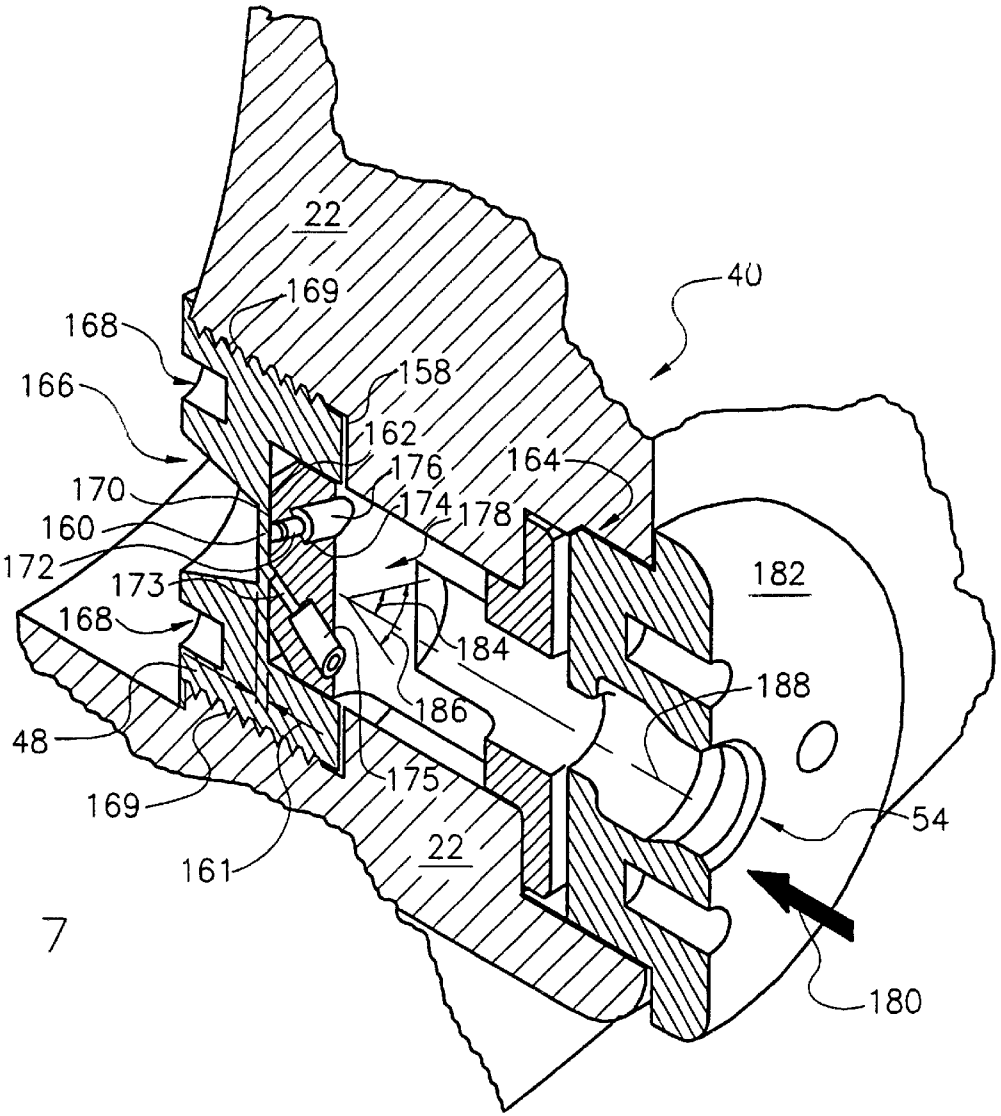
FIG. 7 is a sectioned, perspective view of a leak detection mechanism for implementation in an apparatus in accordance with the invention.

Referring to FIG. 7, a leak detector 40 may be formed to have a channel 54 or cavity 54 adapted to receive fiber optic lines. In one embodiment, a clearance 158 may be provided between the head 22 and the mount 48, assuring intimate access of the leak detector 40 to the window 160. The thickness 161 of the window 160 may be selected to render the window 160 transparent or translucent with respect to the quantity, wave length, and intensity of light required by the leak detector 40. The leak detector 40 is optical in nature. Accordingly, a face 162 may be formed at one end of the body 164 for fitting against the windows 160. A clearance 166 may be provided on an opposite side of the window 160.

In one embodiment, pin tool holes 168 may be provided. Remaining material supports against stresses and distortions in the mount 48. Thus, the apparatus provides for assembly and dimensional stability in the window 166.

A seal clearance 170 may be provided at the front of a passage 172 adapted to receive a fiber 173. The fiber 173 may be glass or polymeric. In one presently preferred embodiment, the fiber 173 may be an acrylic plastic. Glass tends to be particularly brittle and not well adapted to handling. Thus, a clearance 170 may be provided for sealing the passage 172 with a nonreactive material. As a practical matter, the window 160 already provides a seal. Thus, the sealing clearance 170 is optional.

A face 174 or shoulder 174 is provided in one embodiment to restrict and position a sheath 175 surrounding a fiber 173. In one embodiment, a fiber 173 is stripped of a sheath 175 for a distance sufficient to extend through the channel 172. Accordingly, the passage 176 accommodates the entire sheath 175, while the shoulder 174 positions the end of the sheath 175, thereby permitting the fiber optic line 173 to extend toward the window 160.

In one embodiment, a slot 178 may be formed in the leak detector 40. The slot 178 is adapted to receive the sheath 175 and contained line 173 from both the channels 172 (only one is shown). The sheath 175 or leads 175 may then traverse from the slot 178 to be gathered into a channel 54 passing out of the leak detector 40. The slot 178 has a primary effect of permitting the channels 172 to be positioned at a half angle 184 or full angle 186 of a center line 188. Thus, the slot 178 provides adequate room for the turning required by the sheath 175 without damage to the fibers 173 or lines 173 of fiber optic material. Accordingly, the sheath 175 may then be routed throughout the channel 54, exiting the leak detector 40.

In one embodiment, a load 180 may be applied by a retainer 44 engaging the head 22. The load 180 may be applied directly by the head 182 of the leak detector 40. Thus, end of a contact may be maintained between the face 162 and the mount 48 and particularly the window 160.

In operation one of the lines 173 may conduct a light beam to the window 160. The light may be directed by the change in the index of refraction between the material in the line 173, the window 160, and air in the clearance 166 or the cavity 17 (chamber 17 of the chamber 18). Thus, light directed from a line 173 is reflected back to the receiving fiber, in the presence of air. In the presence of a liquid, however, such as may occur during a leak caused by diaphragm or seal failure, the clearance 166 may become filled with a liquid. Accordingly, the index of refraction for light passing from the line 173 through the window 160, and into the liquid 160 may be used to determine the angle 186 between the channels 172 and the lines 173. The presence of liquid in the clearance 166 disburses the incoming light, thereby changing the index of refraction of the light reflected through clearance 166, which is detected by the leak detector 40. Thus, the leak detector 40 detects any change in the index of refraction which may be caused by a liquid or a gas leaking into the clearance 166. In one embodiment, the window 160 may be positioned near to the diaphragm 60. In such an embodiment, a reflection of light from the diaphragm proximate the window 160 may be detected by a line 173 receiving from a corresponding line 173 eliminating the diaphragm 60.

The leak detector 40 may operate as an end-of-stroke detector 30. However, the optical signals from the lines 173 must be converted into some kind of mechanical actuation to control the flow of air or other motive fluid or driving fluid into the chamber 17 for driving the diaphragm 60.

Figure 8:
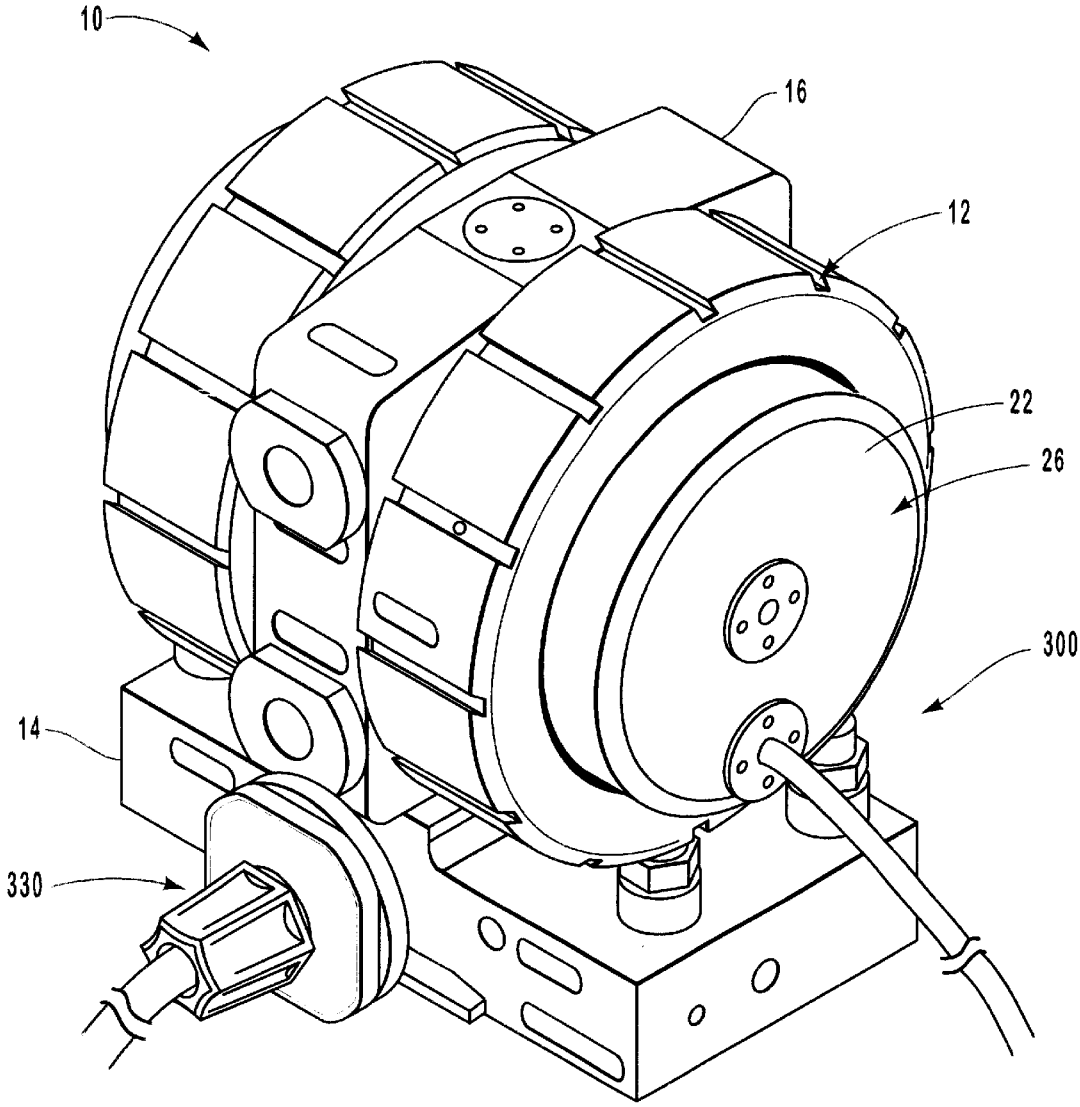
FIG. 8 is a perspective view of a pump illustrating a leak detector and an end of stroke detector in accordance with one embodiment of the present invention.

Referring now to FIG. 8, there is shown a leak detector 300 and an end of stroke detector 330 in accordance with one embodiment of the present invention. In the embodiment, leak detector 300 is adapted to be coupled an aperture of head 22. Leak detector 300 comprises a fiber optic leak detection apparatus adapted to detect the presence of liquids in the chamber actuating the piston. Leak detector is one example of a fiber optic system for detecting a leak in a sealed chamber pump. By providing a mechanism to detect the presence of leaks, leak detector 300 provides a mechanism to signal when pump 12 is in a fail mode. Due to the characteristics of many of the liquids used with apparatus 10, the detection of a leak can allow a user to prevent costly and/or potentially hazardous situations that can be caused by a leak. The configuration of leak detector 300 is also important due to the nature of the liquids often used with high purity pumps. For example, high purity pumps are often used with solvents or acids. By utilizing fiber optics having the configuration of leak detector 300, corrosion by acids is resisted while ignition of solvents is prevented. Additionally, the non-intrusive configuration prevents contamination of the fluids being pumped.

End of stroke detector 330 is coupled to aperture 33 of base 14. End of stroke detector 330 is one example of a fiber optic system for detecting the stroke of a pump. End of stroke detector 330 is configured to indicate the number and rate of oscillations of the pump. The number and rate of oscillations of the pump can be used: 1) to control the pump; 2) for diagnostic purposes; and/or 3) to determine when preventive maintenance of the pump should be conducted. The position of end of stroke detector 330 relative to aperture 33 is adapted to allow: 1) end of stroke detector 330 to detect oscillations of the pump unimpeded by the pilot valve; and 2) end of stroke detector 330 to detect the end of stroke of shuttle valve 90. Due to the self-contained configuration of the pump according to one aspect of the present invention, the pilot valve is positioned adjacent the diaphragm 60. By being positioned adjacent diaphragm 60, the pilot valve can interrupt or impeded the effective cycle counting performed by end of stroke detector 330. By positioning end of stroke detector 330 such that it detects the end of stroke of shuttle valve 90, the operation of end of stroke detector 330 is not interfered by the pilot valve. Additionally, by detecting the end of stroke of shuttle valve 90, end of stroke detector 330 is able to detect the end of stroke of the mechanism that provides the driving force of pump 12. In contrast, configurations in which the end of stroke detector is adapted to detect the end of stroke of diaphragm 60 only permits the user to determine the end of stroke of a member that operates in response to the force provided by shuttle valve 90. In other words, the configuration of end of stroke detector 330 can provide more precise diagnostic feedback than alternative configurations of end of stroke detectors. The configuration of end of stroke detector 330 is also important due to the nature of the liquids often used with high purity pumps. For example, high purity pumps are often used with solvents or acids. By utilizing fiber optics having the configuration of end of stroke detector 330, corrosion by acids is resisted while ignition of solvents is prevented. Additionally, the non-intrusive configuration prevents contamination of the fluids being pumped.

Figure 9:
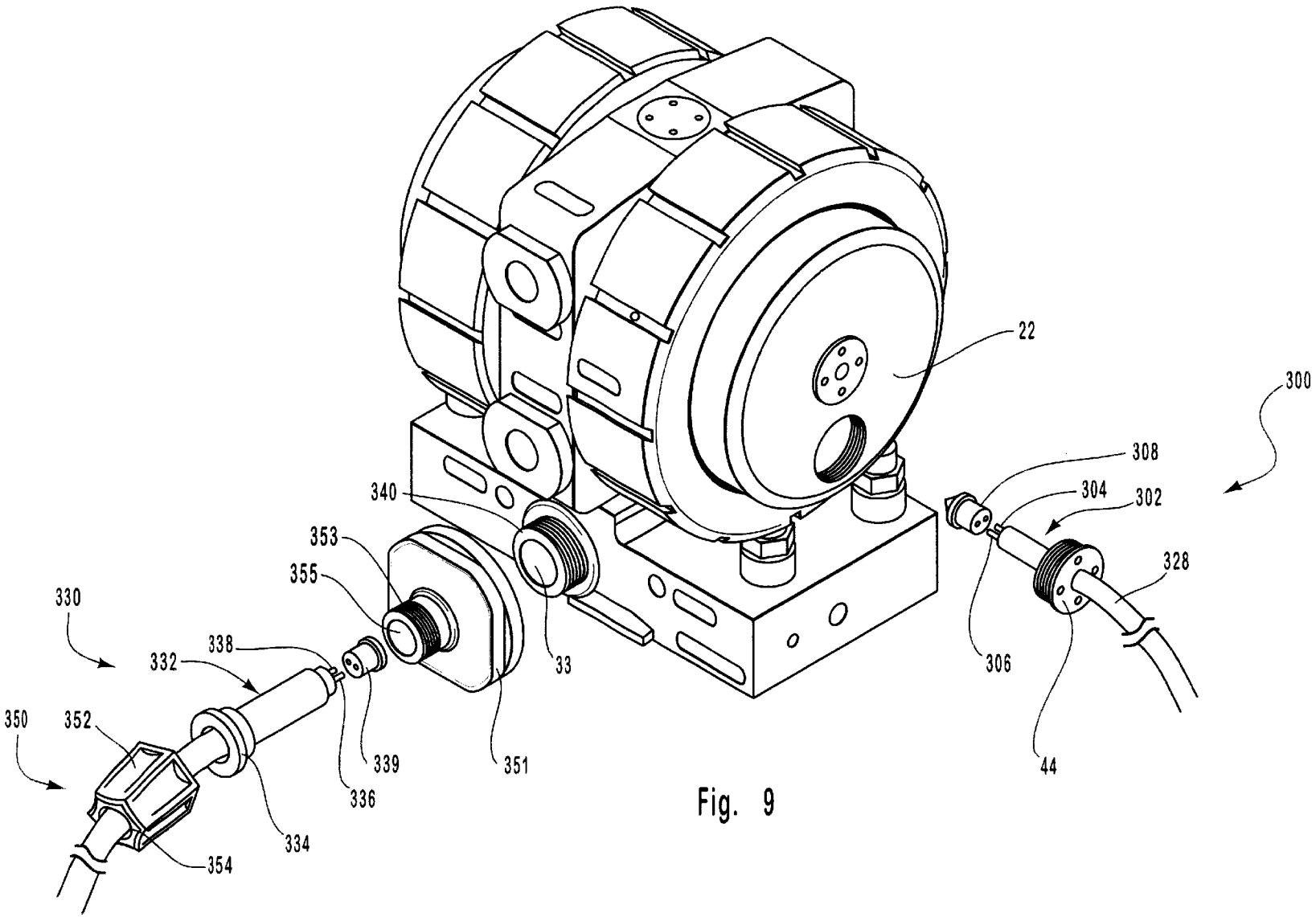
FIG. 9 is an exploded view illustrating the leak detector, end of stroke detector, and coupler assemblies according to one embodiment of the present invention.

With reference now to FIG. 9, there is shown an exploded view of leak detector 300 and end of stroke detector 330 in accordance with one embodiment of the present invention. There is also shown retainer 44 and end of stroke coupler assembly 350 according to one embodiment of the present invention. Leak detector 300 comprises a leak detection member 302, an emitting fiber 304, a receiving fiber 306, and a leak detection member head 310. Leak detection member 302 is adapted to be inserted into the aperture of head 22 such that the leak detection member 302 is positioned internal to an air chamber of the sealed pump apparatus. By being positioned internal to the sealed pump apparatus, leak detection member 302 can more readily detect the presence of even small amounts of liquid that are present in the air chamber as the result of a leak.

Emitting fiber 304 and receiving fiber 306 are positioned internal to, and protruding from the end of, leak detection member 302. Emitting fiber 304 is a fiber optic line adapted to send light that is used to detect the presence of a leak condition. Emitting fiber 304 is one example of a first fiber optic line configured to direct light against a selectively reflective surface. Receiving fiber 306 is adapted to detect the light sent from emitting fiber 304. Receiving fiber 306 is one example of a second fiber optic line configured for receiving light. A leak detection head member 310 is coupled to the anterior end of leak detection member 302. Leak detection head member 310 is adapted to interact with liquid. The configuration of leak detection head member 310 permits the light emitted by emitting fiber 304 to signal the presence or absence of a leak condition. The configuration of emitting fiber 304, receiving fiber 306, and leak detection head member 310 and the mechanism in which emitting fiber 304, receiving fiber 306 and leak detection head member 310 are used to detect the presence of a leak condition will be discussed in greater detail with reference to FIG. 10.

Retainer 44 provides a mechanism to couple leak detector 300 to head 22. Retainer 44 is one example of a coupler assembly for coupling a fiber optic system to a sealed chamber pump. Retainer 44 is adapted to allow a user to attach and remove leak detector 300 from head 22 without twisting the fiber optic lines. In the illustrated embodiment, retainer 44 comprises a includes a threaded portion. Retainer 44 is adapted to threadably engage threads of the aperture of head 22.

With reference now to end of stroke detector 330. End of stroke detector 330 comprises an end of stroke detection member 332, a flange 334 an emitting fiber 336, a receiving fiber 338, an end of stroke detection member head 339. End of stroke detection member 332 is adapted to be positioned internal to aperture 33 of base 14 such that the end of stroke detection member 332 can detect the end of stroke of the shuttle valve 90. Flange 334 is coupled to the posterior end of end of stroke detection member 332. In the illustrated embodiment, flange 334 is adapted to provide a seal between the end of stroke coupler assembly 350 and a threaded mount 340 of base 30.

Emitting fiber 336 and receiving fiber 338 are positioned internal to, and protruding from the end of, end of stroke detector member 332. Emitting fiber 336 emits a light signal that is used to detect the end of stroke of shuttle valve 90. Receiving fiber 338 is adapted to receive the light emitted by emitting fiber 336 to signal the end of stroke of shuttle valve 90. The configuration of emitting fiber 336 and receiving fiber 338 and the method by which they are utilized to detect the end of stroke of shuttle valve 90 will be illustrated in greater detail in FIGS. 11A, 11B. There is shown an end of stroke detection member head 339. End of stroke detection member head 339 is positioned at the anterior end of end of stroke detection member 332. In one embodiment, end of stroke detection member head 339 is integrally coupled to the end of stroke detection member 332. In an alternative embodiment, the end of stroke detection member head 339 is not integrally coupled to the end of end of stroke detection member 332.

End of stroke coupler assembly 350 is configured to couple the end of stroke detector 330 to base 14. End of stroke coupler assembly 350 is one embodiment of a coupler assembly for coupling a fiber optic system to a sealed chamber pump. In the illustrated embodiment, end of stroke of stroke coupler assembly 350 comprises a coupler 351 and a threaded sleeve 352. Coupler 351 is adapted to threadably engage a mount 340 of base 14. In the preferred embodiment, coupler 351 is comprised of a resilient material such as rubber to provide the desired sealing functionality. Coupler 351 includes a threaded mount 353 and an aperture 355. Threaded mount 353 provides a mechanism on which threaded sleeve 352 can be coupled. Aperture 355 allows end of stroke detection member 332 to be inserted into aperture 33 of base 14. When end of stroke detection member 332 is fully inserted into aperture 355, flange 334 abuts threaded mount 353 such that a seal is formed therebetween. Threaded sleeve 352 is adapted to be positioned posterior to end of stroke detection member 332 while threadably engaging threaded mount 353 of coupler 351. Threaded sleeve 352 includes a bore 350 permitting the fiber optic cable to pass therethrough. When threaded sleeve 352 is threadably enagaged with threaded mount 353, flange 334 is sandwiched therebetween forming a moisture impervious seal.

The configuration of end of stroke coupler assembly 350 permits a user to attach or remove the end of stroke detector 330 without twisting the fiber optic lines. As will be appreciated by those skilled in the art, the configuration of end of stroke coupler assembly and leak detector coupler assembly can be of a variety of types and configurations without departing from the scope or spirit of the present invention. In one embodiment, both the end of stroke coupler assembly and a leak detector coupler assembly have the same configuration. In one embodiment, the configuration of the assemblies is similar to that of retainer 44. In an alternative embodiment, the configuration of the assemblies is similar to that of end of stroke coupler assembly 350.

Figure 10A:
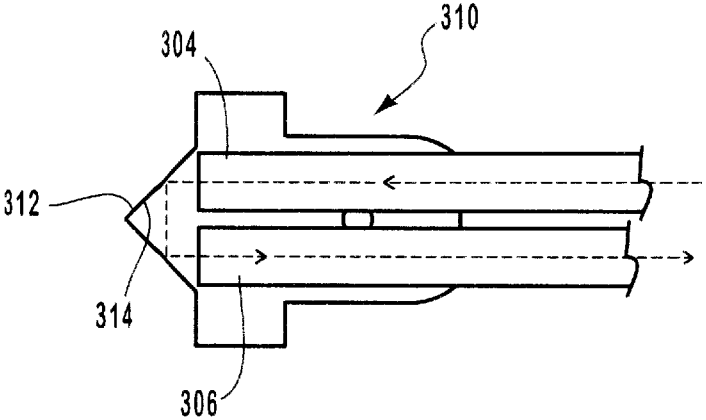
FIGS. 10A and 10B are a cross sectional views illustrating the manner in which the element of the leak detector is utilized to detect the presence of liquid according to one embodiment of the present invention.
Figure 10B:
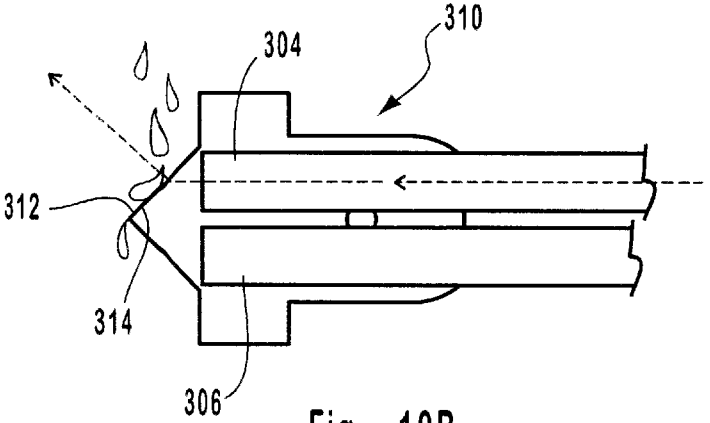

With reference now to FIGS. 10A and 10B, there is shown the mechanism by which emitting fiber 304, receiving fiber 306, and leak detection head member 310 are configured to detect a leak condition. Leak detection head member 310 includes an element 312. In the illustrated embodiment element 312 has a pyramidal configuration. Element 312 has a selectively reflecting surface 314. Selectively reflecting surface 314 is positioned on the interior of element 312. In FIG. 10A it can be seen that the pyramidal configuration of element 312 is such that when emitting fiber 304 emits a light signal, the light internally reflects from selectively reflecting surface 314 and is received by receiving fiber 306. Element 312 is comprised of a material having an index of refraction such that the selectively reflective surface 314 reflects light when the exterior of element 312 is contacted only by air or other similar gases. However, as shown in FIG. 10B, when the exterior of element 312 is contacted by a liquid, light passes through element 312 and selectively reflective surface 314 no longer reflects the light emitted by emitting fiber 304. In one embodiment, element 314 comprises a semi-transparent material. In another embodiment, element 314 comprises a material that is semi-transparent when in contact with air or another gas, but becomes transparent when in contact with a liquid. In yet another embodiment, element 314 is adapted to provide a moisture impervious barrier between the air chamber and the emitting and receiving fibers 304, 306.

Figure 11A:
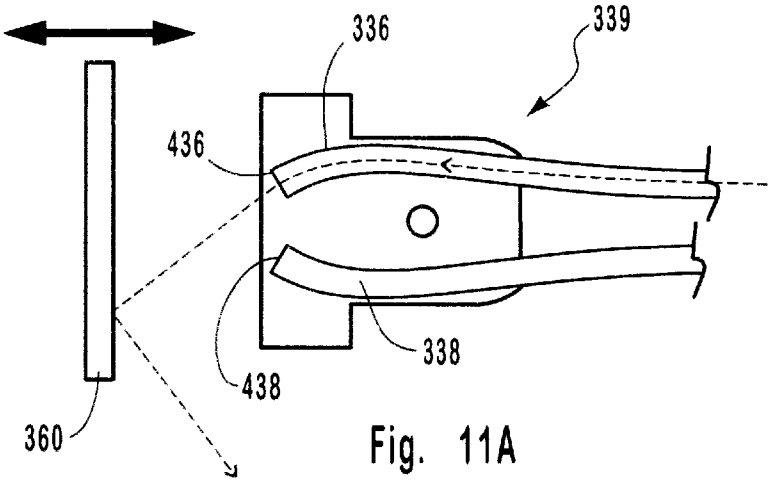
FIGS. 11A and 11B are cross sectional views illustrating the manner in which the end of stroke detector is utilized to detect the end of stroke of an oscillating member according to one embodiment of the present invention.
Figure 11B:
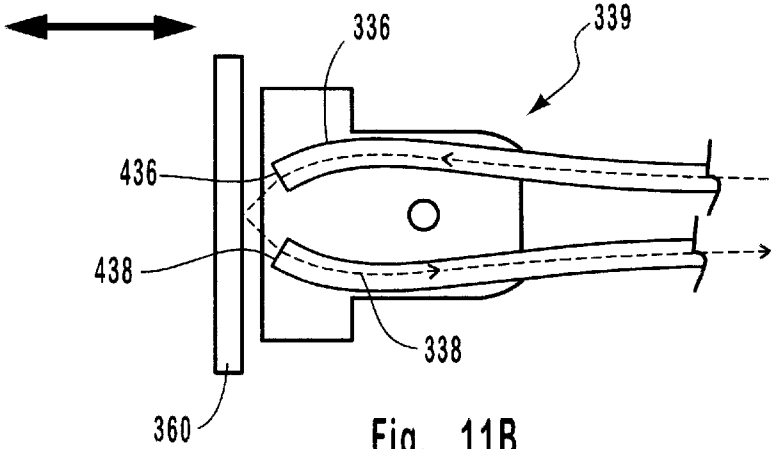

With reference now to FIGS. 11A and 11B, there is shown the manner in which the emitting fiber 336 and the receiving fiber 338 are configured to detect an oscillating member, such as shuttle valve 90, in accordance with one embodiment of the present invention. In the illustrated embodiment, emitting fiber 336 has an emitting surface 436 while receiving fiber 338 has a receiving surface 438. The angle of the emitting fiber, and thus the emitting surface 436, controls the direction of the light signal sent by emitting fiber 336. Similarly, the angle of receiving receiving fiber 338, and thus the receiving surface 438, controls the angle at which light is received by receiving fiber 338. Emitting surface 436 and 438 are configured such that they do not lie in the same plane. Emitting surface 436 is positioned to form an obtuse angle with receiving surface 438. The configuration of emitting fiber 336 and the receiving fiber 338, and the emitting surface 436 and the receiving surface 438, allows the end of stroke of an object 360 to be detected. Due to the configuration of emitting fiber 336 and the receiving fiber 338, and the emitting surface 436 and the receiving surface 438, light reflects off the shuttle valve at an angle. When the distance between the object 360 and emitting fiber 304 exceeds a given displacement, the light signal sent by emitting fiber 304 reflects from object 360 such that receiving fiber 336 does not detect the light signal.

In FIG. 11B it is shown that when the distance between the object 360 and the emitting fiber 304 falls within a given displacement, the light signal sent by emitting fiber 304 reflects from object 360 such that receiving fiber 336 detects the light signal. This provides a digital indication of the end of stroke of an object such as shuttle valve 90. In contrast, where the emitting surface and receiving surface lie in substantially the same plane due to the configuration of the emitting fiber and the emitting surface, a signal is detected irrespective of the distance between the object and the emitting and receiving surfaces. Thus an analog signal is produced in which the intensity of the light must be measured. Measuring analog signals can require more costly and complex circuitry while providing a less reliable indicator of the end of stroke of an object.

Figure 12:
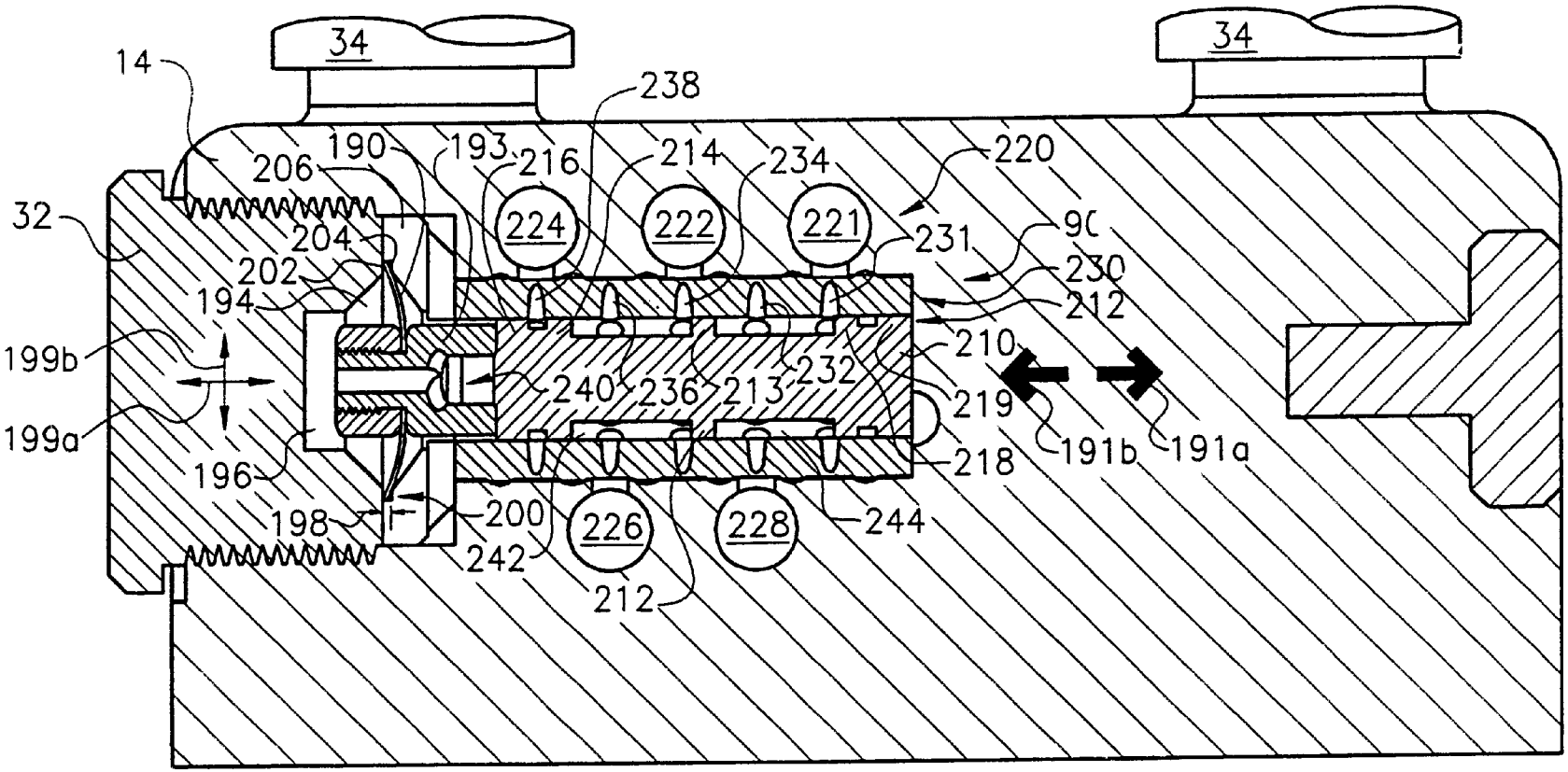
FIG. 12 a sectioned side elevation view (end with respect to the pump) of a spool valve for the air control in the base of an apparatus in accordance with the invention.
Figure 13:
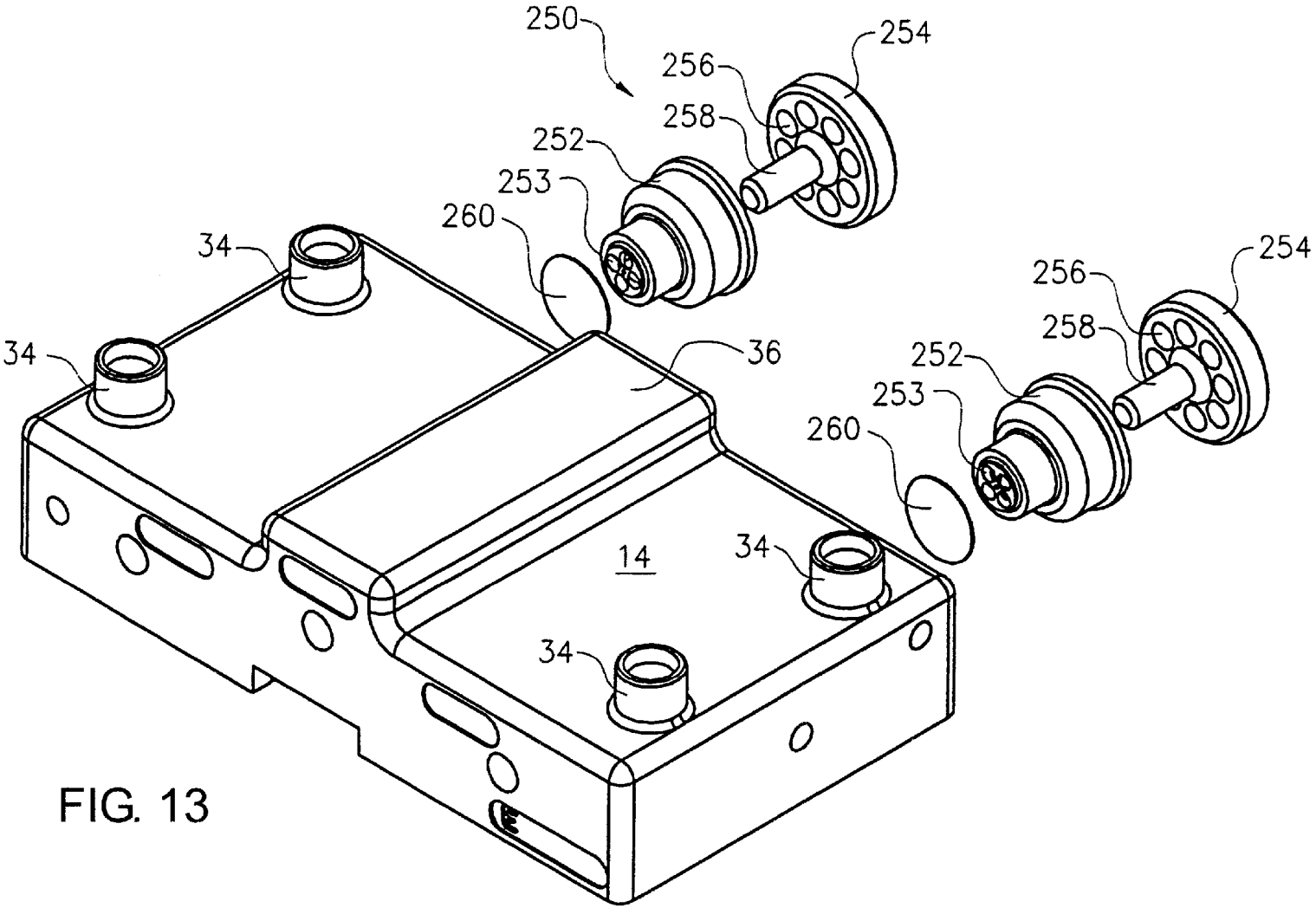
FIG. 13 is a perspective view, partially-exploded, of a base for implementation with an apparatus in accordance with the invention.
Figure 14:
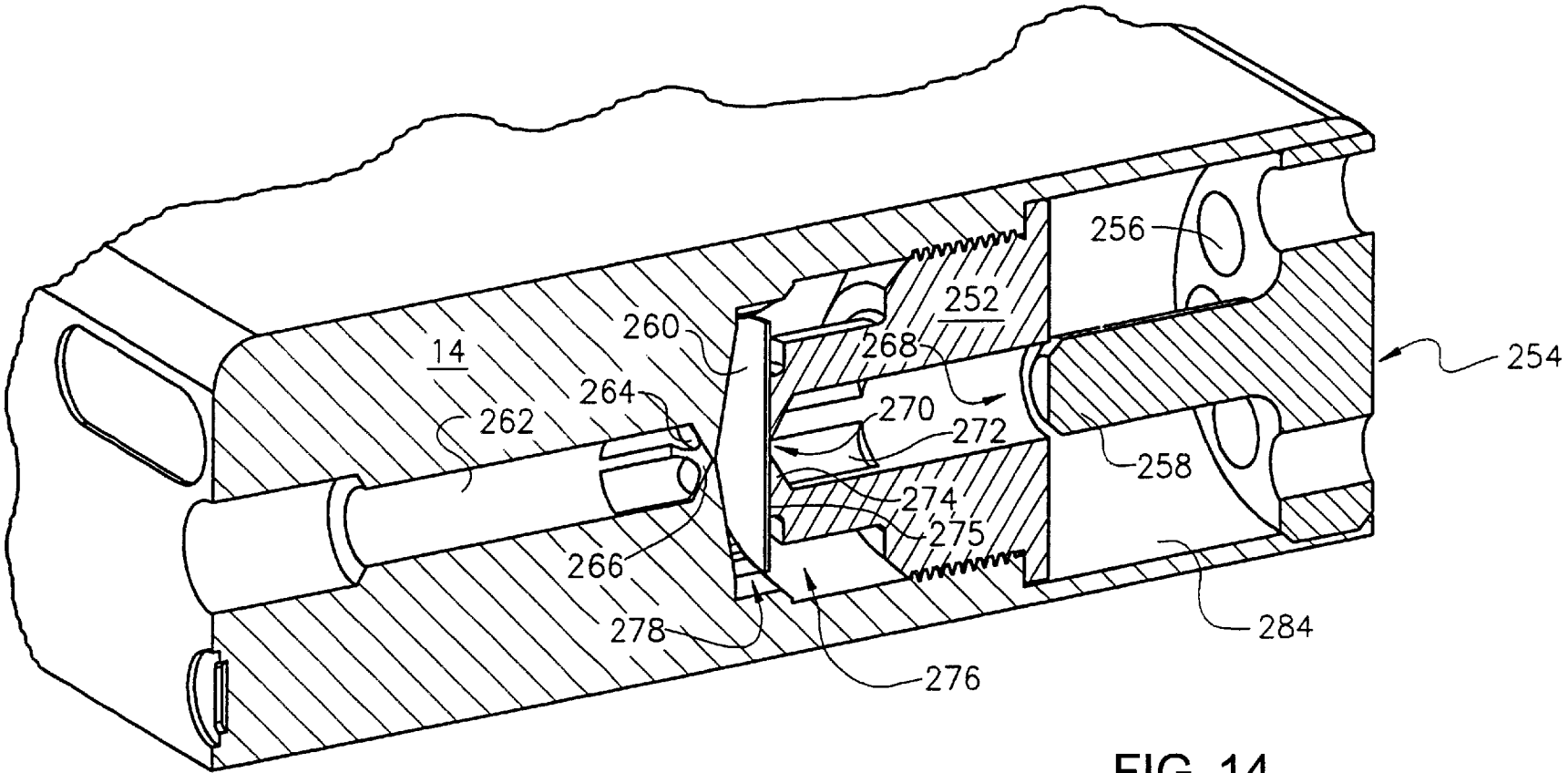
FIGS. 14–15 are a perspective and elevation, respectively, sectioned views, of a quick-release, high-volume, air-exhaust valve for use with an externally controlled air supply for an apparatus in accordance with the invention.
Figure 15:
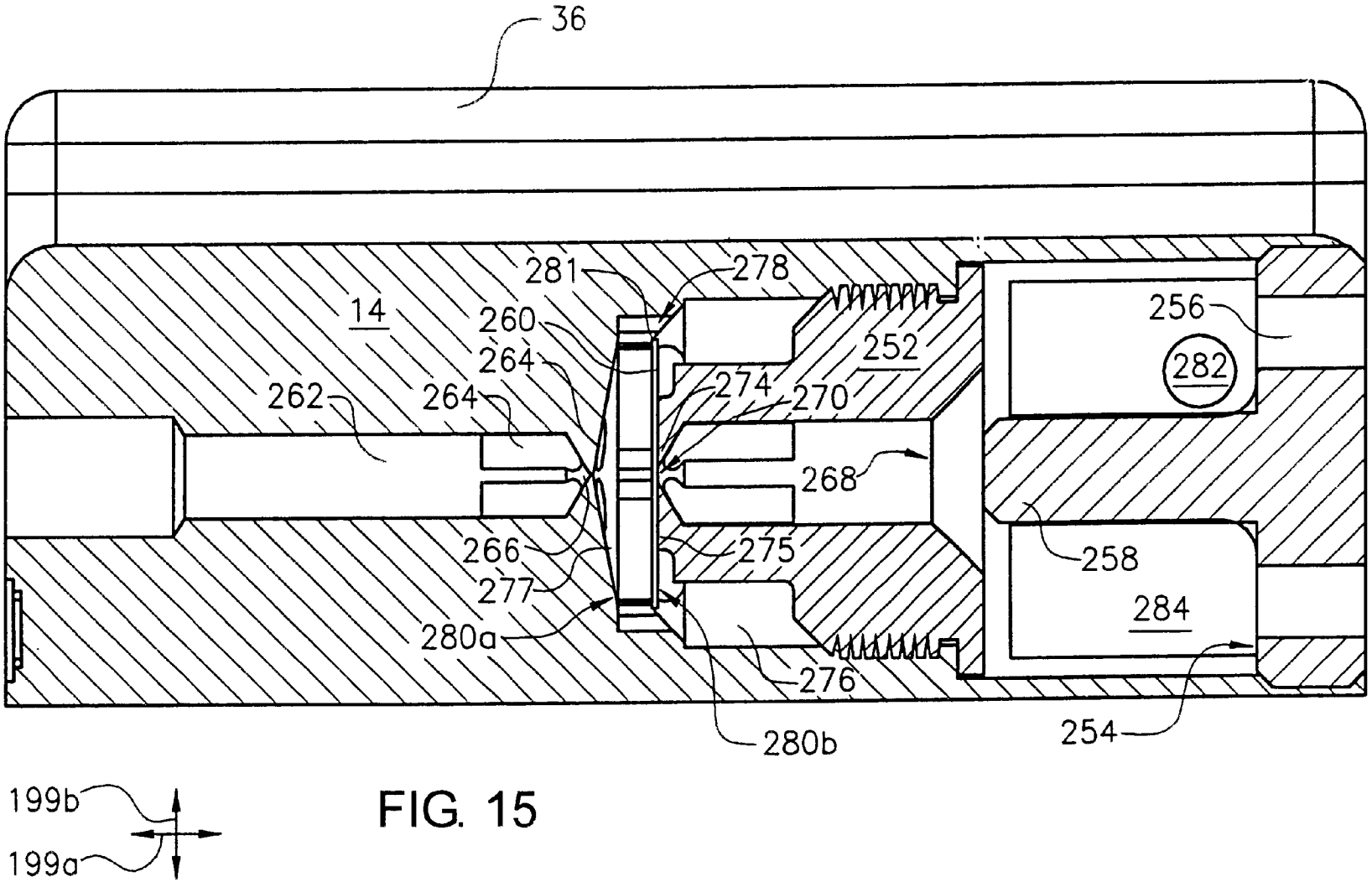

Referring to FIG. 12, a spool valve 90 may be provided with a bias 190 or a bias element 190 for rendering a digital response from the spool valve 90 or shuttle valve 90. In one embodiment, a bias force 191 is provided by the bias element 190 depending on the orientation thereof. The bias 190 is captured by a head 192 or nut 192 secured to a shaft 193, capturing the bias 192 flexibly therebetween.

A chamber 194 adapted for ready movement by the bias 190 is provided by the retainer 32 and a fitting 206. The chamber 194 permits free motion of the bias 190 in a longitudinal direction with respect to the shuttle valve 90. A chamber 196 is formed for receiving the head 192 of the shuttle 90. In one embodiment, a thickness 198 of a gap 200 formed to receive a bias 190 between the retainer 32 and fitting 206 may be critical. Forming a flange in place of the bias 190 provides residual stresses and restraints on deflection thereof.

Clearance is made to accommodate positioning of the bias 190 against a far corner 202 or a near corner 204, with respect to the spool valve 90 or shuttle valve 90. Thus, the bias 190 may be constrained in a radial direction 199*b*, while being completely free in an axial direction 199*a*, so long as the bias force 191 has been overcome. Thus, the bias 190 operates like the bottom of a traditional oil can.

Nevertheless, the constraint in a radial direction 199*b* by the fitting 206 in no way restricts the positioning of the bias 190 in either corner 202, 204. Thus, the bias 190 is free to flip in an axial direction 199*a* upon achievement of sufficient bias force 191. Thus, the bias 190 renders the shuttle 90 a digital valve rather than a proportional valve. Proportional valving has been found to be unreliable, and not sufficiently precise for reliable operation of the pump 12.

By contrast, the bias 190 by being formed of a stiff, comparatively rigid, yet flexible, nonreactive, fail-clean material, such as a chlorofluorocarbon formed in a comparatively strong, stiff sheet, has been found to be effective to provide a digital operation of the spool valve 90 within a narrowly designed range of bias floats 191. The proper provision of a cap 198 that does not constrain the motion of the bias 190 and head 192 in an axial direction 199*a* has been found to be effective to provide such a digital positioning function.

Otherwise, the spool 210 of the spool valve 90 may otherwise operate as understood in the art. The seals 212, generally, and specifically each of the seals 213, 214, 216, 218, 219 operate to direct fluid into a variety of conduits 220 or channels 220. The channels 220 and specifically the channels 221, 222, 224, 226, 228 direct working fluid the operating fluid controlling the movement of the diaphragm in the head 22 of the pump 12 as heretofore described. Porting the working fluid (e.g. air) to the proper diaphragm 60, or chamber 17, in order to drive a diaphragm 60, may be accommodated by the respective channel 220, in response to a seal 212 directing the operating fluid from one port 230 to another 230. Specifically, each of the ports 231, 232, 234, 236, 238 is opened, closed, and transferred between the respective channels 240, 242, 244 as a seal 212 is passed thereover or thereby longitudinally 199*a*.

A driving fluid may be passed in through a channel 240, and onto one of the channels 220. A channel 220 connected to a port 230 may then transfer fluid into a channel 242, 244 selected according to the longitudinal 199*a* position of the spool 210. Thus, a particular seal 212 may direct communication of fluid from one port 230 to another 230 by way of one of the channels 242, 244 extending circumferentially about the spool 210.

In one embodiment, the spool 210 may be formed of a ceramic material. Accordingly, no elastomeric seals are formed anywhere in the apparatus 10. Rather, each of the materials from which the spool 210, head 192, bias 190, fitting 206, retainer 32, and base 14 are formed may be selected from nonreactive, durable non-contaminating, fail-clean materials such as chlorofluorocarbons.

Referring to FIGS. 13–16, a dump valve 250 or fast-relief, exhaust valve 250 may be formed to operate in the base 14 of an apparatus 10 in accordance with the invention. In one embodiment, an insert 252 may be adapted with a muffler 254 to fit into the base 14. The muffler 254 may be provided with multiple ports 256 for dumping large amounts of operating fluid (e.g. air) from a non-recirculating, external driver or controller, after discharge thereof, from the chamber 17 of the pump 12. The post 258 may serve to actuate and align operation of the valve 253.

A disk 260 provides a principal seal 260 for the valve 250. For example, operative fluid may be provided to or from the spool cavity 262. Ports 264 and a support post 266 or cross 266 may be formed to pass operating fluid from the cavity 262, while supporting the structural mechanics of the base 14 and the operation of the disk 260. A channel 268 may similarly be disposed throughout the interior of the insert 252. The channel 268 may communicate through a port 270 in the insert 252.

The port 270 may form an aperture having a flat face 275 adapted to support the disk 260 therein. When the disk 260 is forced by a flow against the disk 260 to contact the flat face 275 the aperture 270 may be effectively closed by the disk 260. The cross 274 supports the flat face 275, providing ports 270 there through while supporting the disk 260 against failure in an axial direction 199*a*.

A channel 276 conducts working fluid away from the disk 260, by passing the fluid from the channel 262, through the ports 264 drilled eccentrically with respect to the channel 262, and accessing a cavity 277 on one side 280*a* of the disk 260. Clearances 278 provide passage for fluid around the perimeter 281 of the disk 260. Accordingly, area in one direction may pass freely around the disk 260, accessing the chamber 276 by way of the clearance 278, which may be fluted to position the disks 260 effectively while still providing passage of fluid. Thus, fluid may pass through a suitable porting mechanism to the port 282 into a chamber 284, for discharge throughout the ports 256 throughout the muffler 254. By contrast, the disk 260 may also be biased to seal against the flat faced 275, closing the ports 270 against passage of loads.

The present invention may be embodied in other specific forms without departing from its structures, methods, or other essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A fiber optic system for detecting the stroke of a pump having a shuttle valve positioned inside a shuttle valve chamber, the shuttle valve adapted to move in a first and second direction within the shuttle valve chamber, the fiber optic system comprising:

a first fiber optic line configured for directing light into the shuttle valve chamber of the pump; and a second fiber optic line configured for receiving light, wherein said first and second fiber optic lines are configured such that light reflects off of the shuttle valve at an angle wherein the second fiber optic line configured for receiving light receives light only when the distance between the shuttle valve and the first and second fiber optic lines is within a predetermined displacement.

2. The fiber optic system of claim 1, wherein the fiber optic system comprises an end of stroke detector.

3. The fiber optic system of claim 1, wherein the first fiber optic line includes a emitting surface.

4. The fiber optic system of claim 3, wherein the second fiber optic line includes a receiving surface.

5. The fiber optic system of claim 4, wherein the light reflects off the shuttle valve at an angle due to the angle formed by the emitting surface and the receiving surface.

6. The fiber optic system of claim 1, wherein the first and second fiber optic lines are disposed at an angle.

7. The fiber optic system of claim 6, wherein the light reflects off the shuttle valve at an angle due to the direction in which the first and second fiber optic lines are disposed.

8. The fiber optic system of claim 1, wherein said fiber optic system generates a digital signal when light is received by the second fiber optic line.

9. The fiber optic system of claim 1, wherein said fiber optic system is resistant to corrosion.

10. The fiber optic system of claim 1, wherein said fiber optic system does not introduce an electrical charge into the shuttle valve chamber.

11. The fiber optic system of claim 1, wherein said fiber optic system is configured such that an ignition source is not introduced into the shuttle valve chamber.

12. The fiber optic system of claim 1, wherein said fiber optic system is adapted to prevent contamination of the fluid in the pump.

13. The fiber optic system as defined in claim 12, wherein said fiber optic system is adapted to prevent contamination of the fluid in the pump by not being positioned in contact with the fluid.

14. A fiber optic system for detecting leak in a sealed chamber pump, a portion of the fiber optic system positioned internal to the sealed chamber pump, the fiber optic system comprising:

an element having a selectively reflective surface, wherein the element is adapted to reflect light when the element is not in contact with liquid and wherein the element is adapted to refract light when the exterior of the element is contacted by a liquid;

a first fiber optic line configured to direct light against the selectively reflective surface of the element; and a second fiber optic line configured for receiving light, wherein said second fiber optic line receives light when the element is not contacted by a liquid, but does not receive light when the element is contacted by liquid.

15. The fiber optic system of claim 14, wherein the element has a pyramidal shape.

16. The fiber optic system of claim 14, wherein the element comprises a semi-transparent material.

17. The fiber optic system of claim 14, wherein the element comprises a material that is semi-transparent when the element is in contact with gas and is transparent when the element is in contact with liquids.

18. The fiber optic system of claim 17, wherein the material is transparent when the element has any contact with liquids.

19. The fiber optic system of claim 14, wherein the element comprises a portion of a leak detection head member.

20. The fiber optic system of claim 14, wherein the element provides a moisture impervious barrier between an air chamber of the sealed member pump and the first and second fibers.

21. The fiber optic system of claim 14, wherein said fiber optic system does not introduce an electrical charge into the sealed chamber pump.

22. The fiber optic system of claim 14, wherein said fiber optic system is configured such that an ignition source is not introduced into the sealed chamber pump.

23. The fiber optic system of claim 14, wherein said fiber optic system is adapted to prevent contamination of the fluid in the pump.

24. The fiber optic system as defined in claim 23, wherein said fiber optic system is adapted to prevent contamination of the fluid in the pump by not being positioned in contact with the fluid being pumped.

25. A coupler assembly for coupling a fiber optic system to a sealed chamber pump, the fiber optic system having fiber optic lines, a detector member, and a detector member head, wherein the coupler permits a user to attach and remove the fiber optic system from the sealed chamber pump without twisting the fiber optic lines, the coupler comprising:

a coupler adapted to be coupled to a mount of the body of the sealed chamber pump;

a sleeve positioned posterior to the detector member head and having the fiber optic lines passing therethrough, the sleeve adapted to be coupled to the coupler, wherein when the sleeve is coupled to the coupler and the coupler is coupled to the threaded mount, the fiber optic system is coupled to the sealed chamber.

26. The coupler assembly of claim 25, wherein a portion of the fiber optic system is adapted to be positioned internal to the sealed chamber pump.

27. The coupler assembly of claim 25, wherein the coupler includes an aperture adapted to permit a portion of the fiber optic system to pass through the coupler.

28. The coupler assembly of claim 27, wherein a flange is coupled to the detector member and wherein the flange is adapted to be sandwiched between the coupler and the sleeve when the sleeve is coupled to the coupler.

29. The coupler assembly of claim 25, wherein the coupler includes a threaded mount.

30. The coupler assembly of claim 29, wherein the sleeve comprises a threaded sleeve adapted to threadably engage the threaded mount of the coupler.

31. The coupler assembly of claim 25, wherein the mount of the body of the sealed chamber pump comprises a threaded mount and wherein the coupler is adapted to threadably engage the threaded mount.

* * * * *

UNITED STATES PATENT AND TRADEMARK OFFICE

CERTIFICATE OF CORRECTION

PATENT NO. : 6,695,593 B1
DATED : February 24, 2004
INVENTOR(S) : Ricky B. Steck et al.

It is certified that error appears in the above-identified patent and that said Letters Patent is hereby corrected as shown below:

Column 1,
Line 24, change “etc.” to -- etc., and --
Line 25, change “reactive or pure,” to -- reactive, or pure --
Line 30, delete “,” after “liquids”
Line 34, change “temperature” to -- high temperature fluids --

Column 2,
Line 9, insert -- variation -- after “extreme”
L;ine 15, change “Pumps” to -- However, these pumps --
Line 20, change “failclean” to -- fail-clean --
Line 48, insert -- , -- after “art”
Line 49, insert -- , -- after “embodiments”
Line 53, delete “,” after “provided”

Column 3,
Line 22, change “chemically consistence” to -- chemical consistency --
Line 42, insert -- the -- before “creation”
Line 46, change “outer most” to -- outermost --
Line 48, change “30 thousands” to -- 30-thousanths --
Line 55, change “there through” to -- therethrough --
Line 63, insert -- to become -- before “loaded out”

Column 4,
Line 8, change “releasing” to -- or the releasing of --
Line 24, change “making” to -- makes --
Line 26, insert -- that -- before “is so effective --
Line 33, delete “the” before “a fiber optic line”
Lines 38-39, change “threads creeping is typical when in tension and shrinking when in compression.” to -- threads creeping when in tension and shrinking when in compression is typical. --
Line 44, change “components,” to -- componenets: --

Column 5,
Line 14, delete “,” after “head”
Line 22, insert -- that is -- after “piston head”
Line 27, delete “,” after “pump”
Line 37, change “abrasive” to -- abrasion --
Line 51, change “loads, tolerate” to -- loads and tolerate --
Line 52, insert -- the -- after “soaking”
Line 62, insert -- , -- after “organic”
Line 62, insert -- , -- after “(gases, air)”

UNITED STATES PATENT AND TRADEMARK OFFICE

CERTIFICATE OF CORRECTION

PATENT NO. : 6,695,593 B1
DATED : February 24, 2004
INVENTOR(S) : Ricky B. Steck et al.

It is certified that error appears in the above-identified patent and that said Letters Patent is hereby corrected as shown below:

Column 6,
Line 6, insert -- the -- before "fluid conduits"
Line 11, change "users" to -- user's --
Line 25, insert -- the -- before "control"
Line 33, insert -- the -- before "atmosphere"
Line 34, insert -- as -- before "a distribution"
Lines 36-37, change "pump. Adapted" to -- pump that is adapted --
Line 37, insert -- different -- before "control schemes"
Line 49, change "pump, on the other hand" to -- pump. On the other hand --
Line 52, insert -- thereby -- before "maintaining"
Line 59, isnert -- is critical -- after "or the like".
Line 60, change "detecting" to -- that detects --
Line 61, change "and the return" to -- , and the return, --
Line 61, insert -- that is -- before "driving"

Column 7,
Line 4, change "pressure" to -- pressures --
Line 13, change "spool. A disk" to -- spool and a disk --
Line 19, insert -- axially with respect to the spool -- after "change position"
Line 22, delete "axially with respect to the spool" after "opposite direction"
Line 28, delete "a" after "against"
Line 41, delete "at" after "against a port"
Line 42, insert -- , -- after "center therefor"
Line 42, insert -- , -- after "side thereof"
Line 45, change "back flow" to -- backflow --
Line 57, delete "nearly" after "opposite side"

Column 8,
Line 7, change "used. Acrylic" to -- used as acrylic --
Line 14, delete "," after "with fluid"
Line 15, chane "controller, unresponsive" to -- controller that is unresponsive --
Line 24, insert -- that -- after "intensity indicates"
Line 27, insert -- , -- after "refraction"
Line 27, insert -- , -- after "film layer"
Line 33, insert -- line -- after "fiber optic"
Line 45, delete "as" before "in parallel lines"
Line 50, delete "the" before "construction"
Line 53, insert -- is only allowed -- after "adjusted"
Line 54, change "the range" to -- this range --
Line 58, change "position. Whenever" to -- position whenever --
Line 61, insert -- , -- after "purposes"

UNITED STATES PATENT AND TRADEMARK OFFICE

CERTIFICATE OF CORRECTION

PATENT NO. : 6,695,593 B1
DATED : February 24, 2004
INVENTOR(S) : Ricky B. Steck et al.

It is certified that error appears in the above-identified patent and that said Letters Patent is hereby corrected as shown below:

Column 9,
Lines 17 and 19, delete "," after "side"
Line 25, change "sectioned side," to -- sectioned, side --
Line 51, change "partially-exploded" to -- partially exploded --
Line 54, delete "a" before "perspective"
Lines 54-55, change "elevation, respectively, sectioned views," to -- elevation sectioned views, respectively, --
Line 62, insert -- the -- after "illustrated in"

Column 10,
Line 9, delete "of" after "manufactured"
Line 25, change "factory-integrated" to -- factory integrated --
Line 26, change "opportunities to damage or alter" to -- probability of damaging or altering --
Line 27, if the changes for line 26 are performed, change "are" to -- is --
Line 29, insert -- being -- before "creep-prone"

Column 11,
Line 5, change "primary-creep" to -- primary creep --
Line 11, insert -- , -- after "body 16"
Line 11, insert -- that is -- after "displacement"
Line 12, insert -- , -- after "secondary creep"
Line 15, change "body 16 may" to -- body 16, there may --
Line 16, change "providing" to -- that provide --.
Line 17, insert -- thereby -- before "preventing backflow"
Line 25, insert -- either -- before "near the detector:

Column 12,
Line 12, change "head and forming" to -- head, forming --
Line 24, change "formed" to -- form --
Line 25, insert -- that is -- before "adaptable"
Line 53, insert -- , -- after "separate fluids"
Line 53, insert -- , -- after "drive fluids"
Line 54, delete "," after "driver 62"

UNITED STATES PATENT AND TRADEMARK OFFICE

CERTIFICATE OF CORRECTION

PATENT NO. : 6,695,593 B1
DATED : February 24, 2004
INVENTOR(S) : Ricky B. Steck et al.

It is certified that error appears in the above-identified patent and that said Letters Patent is hereby corrected as shown below:

Column 13,
Line 2, insert -- , and -- after "driver 62"
Line 11, change "position" to -- positioned --
Line 18, delete "against" after "approaches"
Line 23, delete "a" before "the body 16"
Line 28, insert -- direction -- before "without production"
Line 36, change "on clearance" to -- of clearance --
Line 38, insert -- , -- after "body 16"
Line 48, insert -- that is -- before "formed by the head"
Line 67, change "1b" to -- 11b --

Column 14,
Line 2, insert -- , thereby -- after "wedge 80"
Lines 7-8, change "toward the body 16 longitudinally 11a." to -- , longitudinally 11a toward the body 16. --
Line 11, insert -- , -- after "head 22"
Line 35, insert -- , -- after "portions 17, 19"
Line 36, insert -- poriton -- before "17, 19"
Line 45, change "intimate bond, gas-tight" to -- intimate, gas-tight bond, --
Line 52, change "effective to" to -- that effectively --
Line 61, insert -- , -- after "portion 102"

Column 15,
Line 43, insert -- or -- before "chemically compatible"

Column 16,
Line 54, insert -- the -- before "end of a contact"
Line 55, insert -- , -- after "mount 48"
Line 56, insert -- , -- after "In operation"
Line 60, delete "the" before "chamber 18"
Line 62, delete "," after "fiber"
Line 67, insert -- , -- after "liquid 160"

Column 17,
Line 11, insert -- that is -- before "receiving"
Line 11, change "line 173 eliminating" to -- line 173, thereby eliminating --
Line 21, insert -- to -- after "coupled"
Line 24, change "leak detector" to -- The leak detector 300 --
Line 41, change "End of stroke" to -- The end of the stroke --
Line 65, insert -- 330 -- after "stroke detector"

UNITED STATES PATENT AND TRADEMARK OFFICE

CERTIFICATE OF CORRECTION

PATENT NO. : 6,695,593 B1
DATED : February 24, 2004
INVENTOR(S) : Ricky B. Steck et al.

It is certified that error appears in the above-identified patent and that said Letters Patent is hereby corrected as shown below:

Column 18,
Line 3, insert -- other -- after "configurations of"
Line 40, insert -- the pumped -- before "fluid"
Line 45, insert -- , -- after "fiber 306"
Line 55, change "a" to -- and -- before "includes"
Line 60, insert -- , -- after "flange 334"
Line 61, insert -- and -- after "fiber 338, --

Column 19,
Line 26, delete "of stroke" before "coupler assembly 350"
Line 63, insert -- , -- after "embodiment"

Column 20,
Line 28, delete "receiving" after "angle of receiving"

Column 21,
Line 39, insert -- , -- after "channels 220"
Line 40, insert -- , -- after "228"
Line 40, delete "working fluid" after "direct"
Line 50, change "or thereby" to -- , or thereby --
Line 63, delete "are formed" before "may be selected"
Line 64, insert -- , -- after "durable"
Line 65, insert -- , -- after "materials"
Line 66, delete "," after "fast-relief"

Column 22,
Line 30, insert -- the -- after "Accordingly,"
Line 39, change "faced" to -- face --

UNITED STATES PATENT AND TRADEMARK OFFICE

CERTIFICATE OF CORRECTION

PATENT NO. : 6,695,593 B1
DATED : February 24, 2004
INVENTOR(S) : Ricky B. Steck et al.

It is certified that error appears in the above-identified patent and that said Letters Patent is hereby corrected as shown below:

Column 23,
Line 2, change "a" to -- an -- before "emitting surface"

Signed and Sealed this

Fourteenth Day of September, 2004

JON W. DUDAS
*Director of the United States Patent and Trademark Office*